US007156485B2

(12) United States Patent
Nishi et al.

(10) Patent No.: US 7,156,485 B2
(45) Date of Patent: Jan. 2, 2007

(54) LIQUID DISCHARGE HEAD, CLEANING METHOD THEREOF, AND LIQUID DISCHARGE APPARATUS

(75) Inventors: Shota Nishi, Kanagawa (JP); Yuji Yakura, Kanagawa (JP); Makoto Ando, Tokyo (JP); Hiroshi Tokunaga, Tokyo (JP)

(73) Assignee: Sony Corporation, Tokyo (JP)

( * ) Notice: Subject to any disclaimer, the term of this patent is extended or adjusted under 35 U.S.C. 154(b) by 210 days.

(21) Appl. No.: 10/477,481

(22) PCT Filed: Mar. 14, 2003

(86) PCT No.: PCT/JP03/03110

§ 371 (c)(1),
(2), (4) Date: Apr. 5, 2004

(87) PCT Pub. No.: WO03/076192

PCT Pub. Date: Sep. 18, 2003

(65) Prior Publication Data

US 2004/0165031 A1 Aug. 26, 2004

(30) Foreign Application Priority Data

Mar. 14, 2002 (JP) ..... 2002-070887
Mar. 14, 2002 (JP) ..... 2002-070888

(51) Int. Cl.
*B41J 2/165* (2006.01)

(52) U.S. Cl. ..... 347/33; 347/30

(58) Field of Classification Search ..... 347/33, 347/29

See application file for complete search history.

(56) References Cited

U.S. PATENT DOCUMENTS 6,460,967 B1 * 10/2002 Makita et al. ..... 347/33
2002/0126176 A1 * 9/2002 Nishi et al. ..... 347/29

FOREIGN PATENT DOCUMENTS

| | | | |
|---|---|---|---|
| EP | 945270 | A2 | 9/1999 |
| EP | 1236576 | A1 | 9/2002 |
| JP | 04-50234 | | 4/1992 |
| JP | 4-185450 | A | 7/1992 |
| JP | 10-151759 | A | 6/1998 |
| JP | 11-342621 | A | 12/1999 |
| JP | 2001-270136 | A | 10/2001 |
| JP | 2002-19131 | A | 1/2002 |

* cited by examiner

*Primary Examiner*—Stephen Meier
*Assistant Examiner*—Ly T. Tran
(74) *Attorney, Agent, or Firm*—Robert J. Depke; Rockey, Depke, Lyons & Kitzinger LLC

(57) ABSTRACT

On a liquid discharge head including an ink discharge surface (6) having rows of ink discharge holes (13) each for discharging different colors of ink, a cleaning roller (7) formed of a cylindrical elastic material touching the ink discharge surface (6) is moved relative to the ink discharge surface (6). This movement causes the pressure inside the ink discharge holes (13) to change and, as a result, the ink (15) inside the ink discharge holes (13) is absorbed. In this way, a ink discharge head, a method for cleaning thereof, and a ink discharge apparatus that do not damage the ink discharge surface (6) with the ink discharge holes (13) and that have improved effectiveness of cleaning the vicinity of the ink discharge holes (13) are provided.

17 Claims, 20 Drawing Sheets

LIQUID DISCHARGE HEAD, CLEANING METHOD THEREOF, AND LIQUID DISCHARGE APPARATUS

This application claims priority to Japanese Patent Application Number JP2002-070887, filed Mar. 14, 2002, and JP2002-070888, filed Mar. 14, 2002, and WIPO Patent Application Number PCT/JP03/03110, filed Mar. 14, 2003, which are incorporated herein by reference.

TECHNICAL FIELD

The present invention relates to a liquid discharge head for discharging liquid such as ink for forming images on a recording medium from liquid discharge holes such as ink discharge holes. The present invention also relates to a method for cleaning for the liquid discharge head and to a liquid discharge apparatus.

BACKGROUND ART

An inkjet printer is an example of a liquid discharge apparatus equipped with a liquid discharge head having a liquid discharge surface with rows of liquid discharge holes for discharging liquid droplets. Inkjet printers are widely used for reasons such as low operating cost, color printed images, and the compact size of the apparatuses.

A typical inkjet printer records images by discharging minute amounts of ink from minute ink discharge holes formed on an ink discharge surface on a print head. When printing is not performed for a long period of time and ink is not discharged from the ink discharge holes of the print head, the ink attached around the ink discharge holes on the ink discharge surface from the previous printing operation may vaporize and dry, causing the ink to thicken or to solidify. As a result, a normal ink-discharge operation may become difficult.

Thus, for known inkjet printers, a moderately firm rubber blade is pressed against the ink discharge surface of the print head and slid along the ink discharge surface. In this way, the thickened and solidified ink attached to the ink discharge surface is wiped off to clean the print head. Related to this, technology for improving the effectiveness of wiping by rotating a plurality of blades attached on a rotation axis is disclosed in Japanese Unexamined Patent Application Publication No. 57-34969.

In Japanese Unexamined Patent Application Publication No. 56-101866, technology for removing ink and dust from ink discharge holes by suction using a suction pump is disclosed.

In such known technology, a moderately firm rubber blade is pressed against the ink discharge surface of the print head and slid along ink discharge surface to wipe off ink on the ink discharge surface. This blade applies great force to the ink discharge surface and, in some cases, damages the ink discharge surface. When using the blade, cleaning depends solely on the effectiveness of wiping. However, when the ink discharge holes are cleaned only by wiping, sometimes ink residues are left in the holes. Similarly, even when a plurality of blades is used, sometimes the ink discharge surface is damaged and ink residues are left around the ink discharge holes.

When removing ink and dust from the ink discharge holes using suction pumps, extra ink needs to be sucked out from the ink discharge holes. As a result, ink of the inkjet head is wasted.

DISCLOSURE OF INVENTION

An object of the present invention is to solve the above problems and provide a liquid discharge head, a method for cleaning for the liquid discharge head, and a liquid discharge apparatus wherein the liquid discharge surface having liquid discharge holes is undamaged and the effectiveness of cleaning the vicinity of the liquid discharge holes is improved.

To achieve the above object, the present invention is provided as described below.

An inkjet head according to the present invention is a liquid discharge head having a liquid discharge surface with rows of liquid discharge holes for discharging liquid droplets. The inkjet head is equipped with a cleaner composed of a cylindrical elastic material and means for moving the cleaner relative to the liquid discharge surface while the cleaner is touching the liquid discharge surface. As the peripheral surface of the cleaner touching the liquid discharge surface moves, the pressure inside the liquid discharge holes change and the liquid inside, the liquid discharge holes is absorbed.

The cleaner composed of a cylindrical elastic material touching the liquid discharge surface is moved relative to the liquid discharge surface. As the peripheral surface of the cleaner touching the liquid discharge surface moves, the pressure inside the liquid discharge holes changes and the liquid inside the liquid discharge holes is absorbed and removed. In this way, the liquid discharge surface is undamaged and the effectiveness of cleaning the vicinity of the liquid discharge holes is improved.

The cleaner has a plurality of minute pores on its peripheral surface. The liquid is absorbed from the liquid discharge holes when the cleaner touching the liquid discharge surface moves and causes the pressure inside the liquid discharge holes to change. The liquid is caught inside the minute pores by capillary action of the plurality of minute pores on the peripheral surface. As a result, the liquid is completely cleaned off from the liquid discharge surface and no ink residues are left behind.

The cleaner is composed of a material consisting of at least one of the two types of cells: closed cells or open cells. In this way, the liquid caught by the peripheral surface of the cleaner is absorbed into the pores made up of the cells by capillary action. Consequently, contamination caused by the absorbed (removed) liquid can be prevented and the effectiveness of cleaning the vicinity of the liquid discharge holes is improved.

A method for cleaning for a liquid discharge head according to the present invention is a method for cleaning for a liquid discharge head having a liquid discharge surface with rows of liquid discharge holes for discharging liquid droplets. More specifically, the method for cleaning is for moving the cleaner, which is composed of a cylindrical elastic material and which touches the liquid discharge surface, relative to the liquid discharge surface and for absorbing the liquid inside the liquid discharge holes by the change in pressure inside the liquid discharge holes caused when the peripheral surface of the cleaner moves while touching the liquid discharge surface.

By applying this method, the liquid inside the liquid discharge holes is absorbed and removed by the change in pressure inside the ink discharge holes caused when the peripheral surface of the cleaner moves while touching the liquid discharge surface. In this way, the liquid discharge surface is undamaged and the effectiveness of cleaning the vicinity of the liquid discharge holes is improved.

A liquid discharge apparatus according to the present invention is a liquid discharge apparatus for discharging liquid droplets from rows of liquid discharge holes formed on a liquid discharge surface. The liquid discharge apparatus is equipped with a cleaner composed of a cylindrical elastic material and means for moving the cleaner relative to the liquid discharge surface while the cleaner touches the liquid discharge surface. The liquid discharge apparatus is also equipped with a liquid discharge head for absorbing the liquid inside the liquid discharge holes by a change in pressure inside the ink discharge holes caused when the peripheral surface of the cleaner moves while touching the liquid discharge surface and a head removal mechanism for fixing the liquid discharge head to the main body of the apparatus and for releasing the head from the main body of the apparatus.

For the liquid discharge head, the cleaner composed of a cylindrical elastic material touching the liquid discharge surface is moved relative to the liquid discharge surface. As the peripheral surface of the cleaner touching the liquid discharge surface moves, the pressure inside the liquid discharge holes changes and the liquid inside the liquid discharge holes is absorbed and removed. In this way, the liquid discharge surface is undamaged and the effectiveness of cleaning the vicinity of the liquid discharge holes is improved.

BEST MODE FOR CARRYING OUT THE INVENTION

In the following, an embodiment of the present invention is described in detail by referring to the attached drawings.

Figure 1:
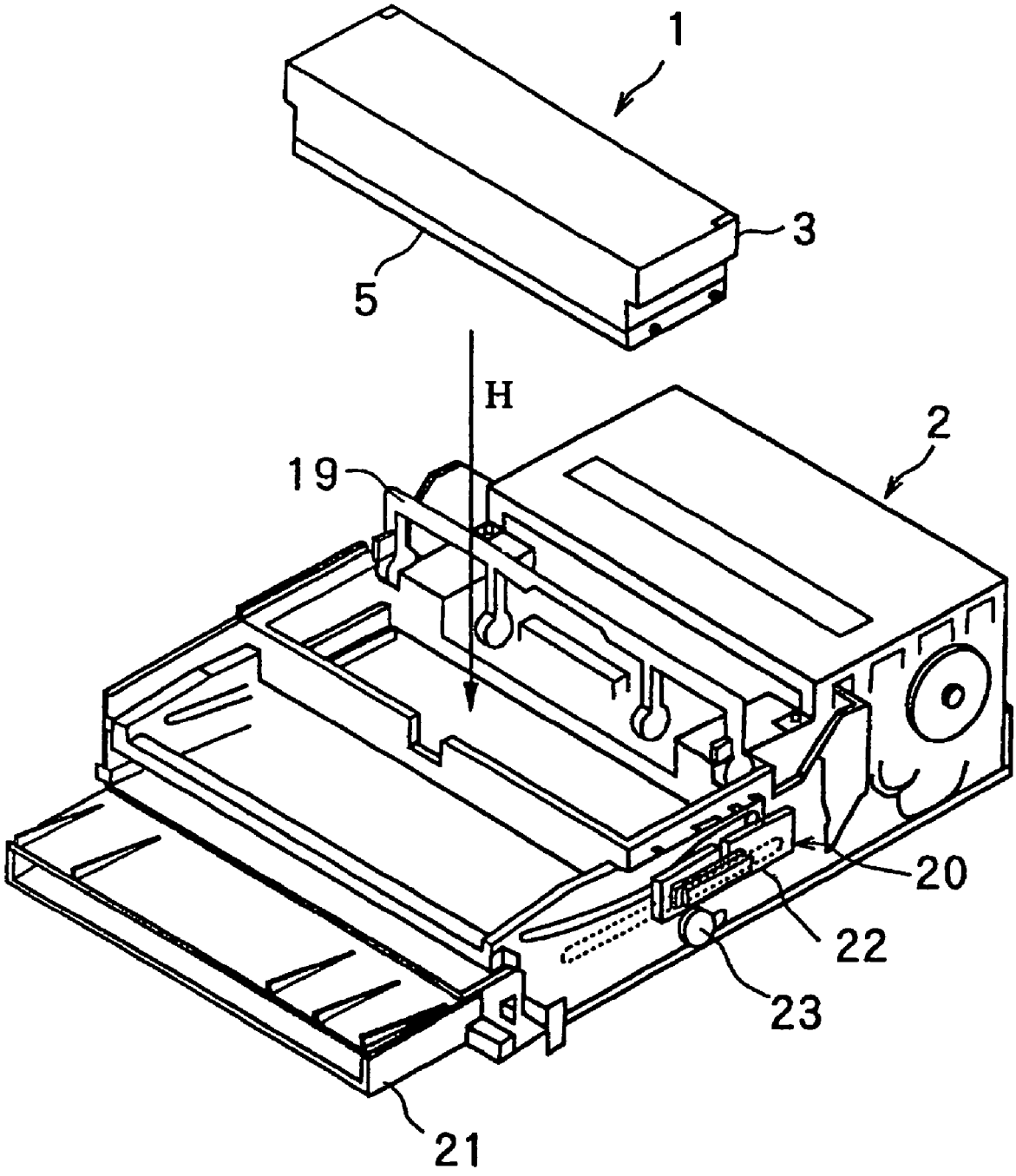
FIG. 1 is a perspective view of an inkjet head according to an embodiment and a printer main body including the inkjet head according to an embodiment.

FIG. 1 is a perspective view of an inkjet head (liquid discharge head) 1 and a printer main body 2 according to this embodiment wherein the inkjet head 1 is fixed to the printer main body 2. FIG. 1 shows an independently formed inkjet head, which is directly fixed to the printer main body 2. By stowing the inkjet head 1 in the direction of arrow H and fixing it to the printer main body 2, an imaging forming apparatus, for example, an inkjet printer (liquid discharging apparatus), is formed.

Figure 2:
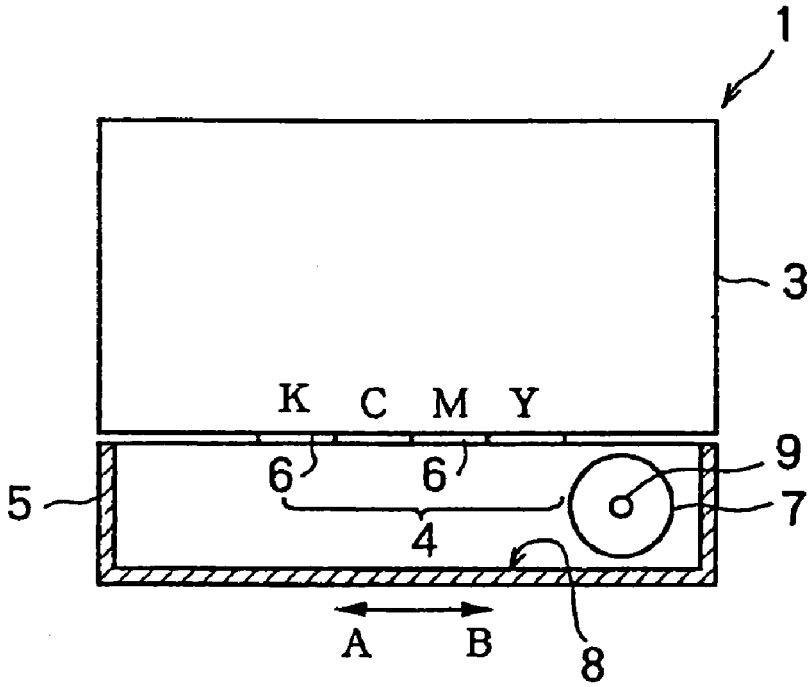
FIG. 2 is an enlarged cross-sectional view of the inkjet shown in FIG. 1.

The inkjet head 1 transforms liquid ink into fine droplet by electro-thermal conversion or electromechanical conversion and then spays ink dots onto recording paper (recording medium). As shown in FIGS. 1 and 2, the inkjet head 1 has an ink cartridge 3, a print head 4, and a head cap 5.

The ink cartridge 3 contains one or several colors of ink in its interior. The case of the ink cartridge 3 has an elongated shape and extends over the entire width of the printer main body 2 shown in FIG. 1 or, in other words, extends over the entire width of the recording paper. Although not shown in the drawing, the inside of the case is partitioned into four ink chambers each filled with a different color of ink: yellow (Y), magenta (M), cyan (C), and black (K). The ink cartridge 3 is formed of a hard resin.

On the bottom of the ink cartridge 3, as shown in FIG. 2 (which is an enlarged cross-sectional view of the inkjet head 1 shown in FIG. 1), a print head 4 is mounted. The print head 4 is for discharging the ink supplied from the ink cartridge 3 as fine droplets. The print head 4 has an ink discharge surface (liquid discharge surface) 6 with ink discharge holes (liquid discharge holes) made of minute holes aligned along the longitudinal direction of the ink cartridge 3 and over the entire width of the recording paper.

The ink discharge surface 6 is formed of, for example, nickel or a material containing nickel by nickel electrotyping and extends in the longitudinal direction of the ink cartridge 3. The ink discharge surface 6 has rows of ink discharge holes for the four different colors of ink (yellow (Y), magenta (M), cyan (C), and black (K)) and a line head is formed as an integral unit for the four colors of ink. Although not shown in the drawing, the portion on the ink discharge surface 6 where the rows of ink discharge holes for each ink, Y, M, C, and K are disposed, and the protruding portion, which is formed by covering the head electrodes with resin and which is positioned on both sides of the ink discharge holes, form a wavy surface.

On the bottom surface of the ink cartridge 3, the head cap 5 is attached. The head cap 5 covers the ink discharge surface 6 of the print head 4 and is a cap for preventing the ink discharge holes from drying and clogging. The head cap 5 is elongated in the same shape as the case of the ink cartridge 3 and is shaped as a shallow, open box without an upper surface. The ink cartridge 3 moves relative to the print head 4 and is detachable. The head cap 5 moves in the directions of arrows A and B, which are the directions orthogonal to the longitudinal direction of the ink discharge surface 6 of the print head 4, by means for moving such as a motor. The head cap 5 is removed from the ink cartridge 3 after moving in the direction of arrow A and then is reattached to the ink cartridge 3 after returning in the direction of arrow B. The head cap 5 is formed of a hard resin.

On the inside of the head cap 5, a cleaning roller 7 is mounted. The cleaning roller 7 is a cleaner for cleaning the ink discharge surface 6 of the print head 4 and is composed of a cylindrical elastic material. The cleaning roller 7 is installed on one of the inner sides of the head cap 5 in the longitudinal direction of the head cap 5. In other words, the cleaning roller 7 is parallel to the longitudinal direction of the ink discharge surface 6 of the print head 4. The cleaning roller 7 moves in the direction of arrow A together with the head cap 5 to clean the ink discharge surface 6 of the print head 4.

Consequently, the head cap 5 is also means for moving the cleaning roller 7 relative to the ink discharge surface 6 while the cleaning roller 7 is touching the ink discharge surface 6 of the print head 4.

On the inside of the head cap 5, an ink receiver 8 is attached. The ink receiver 8 receives the discharged preliminary ink from the ink discharge holes of the print head 4. The discharged preliminary ink is received by a part of the bottom surface or the entire bottom surface of the head-cap 5, which is shaped like a shallow box.

Figure 3:
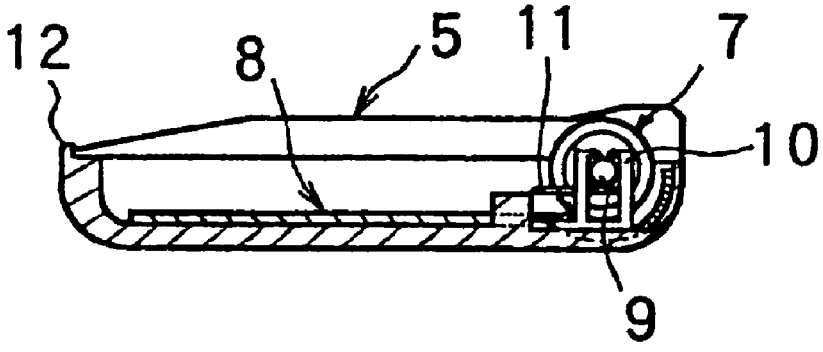
FIG. 3 is a side view showing an embodiment of a head cap and a cleaning roller shown in FIG. 2.
Figure 4:
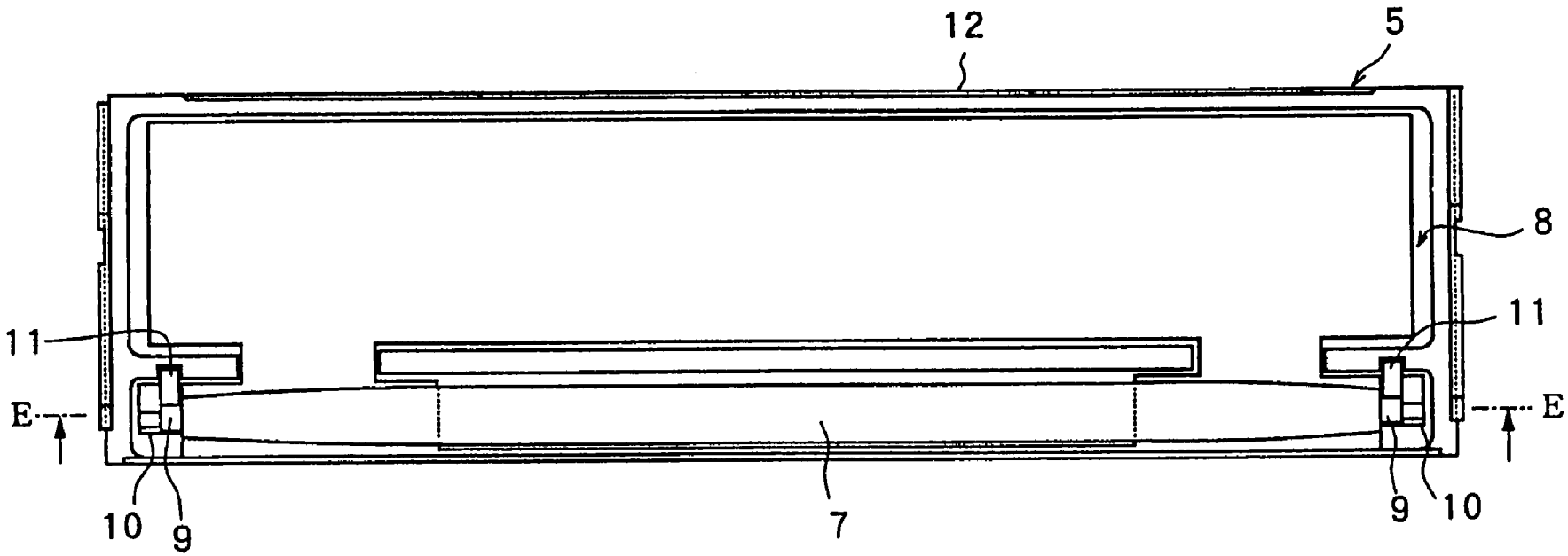
FIG. 4 is a plan view showing the head cap and cleaning roller.

In the following, examples of the head cap 5 and the cleaning roller 7 are described by referring to FIGS. 3 to 5. As shown in FIG. 4, the head cap 5 has an elongated shape with the same length as the width of the ink cartridge 3 shown in FIG. 1. As shown in FIG. 3, the head cap 5 has a bottom surface with side walls on its circumference, forming a shallow, open box without an upper surface. As described above, the head cap 5 moves in the directions of arrows A and B, which are the directions orthogonal to the longitudinal direction of the ink discharge surface 6 of the print head 4. Once the head cap 5 returns in the direction of arrow B and is reattached to the ink cartridge 3, as shown in FIG. 3, a positioning hook 12, which is formed on the upper edge of the side opposite to the cleaning roller 7, functions as mean for positioning. The positioning hook 12 is stopped by the lower edge of the ink cartridge 3 to position the head cap 5.

In the vicinity of the one of the side walls in the longitudinal direction of the print head 4 of the head cap 5, the cleaning roller 7, which is a detachable cylinder touching the full length of the ink discharge surface 6 of the print head 4, is fixed. More specifically, on each edge of the cleaning roller 7, pins 9 are attached, as shown in FIG. 4. The pins 9 are fixed with U-shaped retainers 10, as shown in FIG. 3. The pin receiver of the upper portion of the retainer 10 is opened and closed elastically. When the pins 9 urge the pin receivers, the pin receivers open and receive the pins and then close and stay closed. On the contrary, by pulling up the pins 9, the pin receivers open and the pins can be removed.

Figure 5:
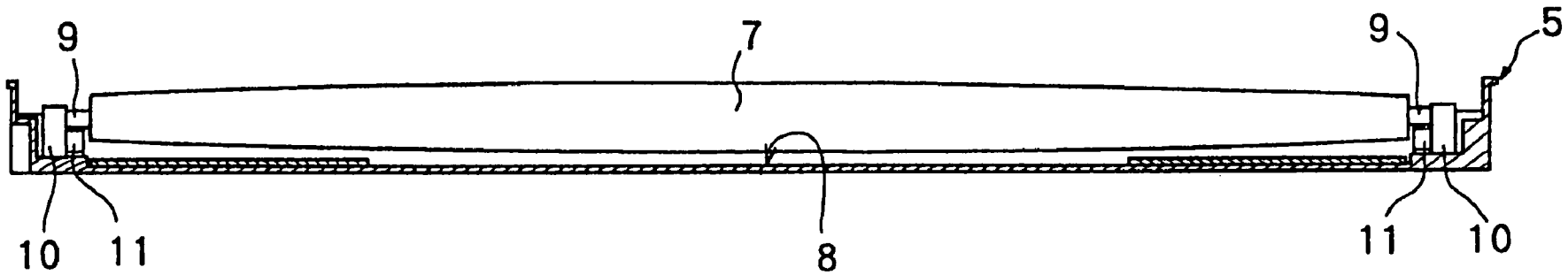
FIG. 5 is a cross-sectional view taken along line E—E of FIG. 4.

The cylindrical cleaning roller 7 is crowned and has a slightly wider diameter in the middle, as shown in FIGS. 4 and 5. The cleaning roller 7 is crowned to prevent it from coming away from the ink discharge surface 6 due to the downward bending of the middle portion of the cleaning roller 7.

The portion of the cleaning roller 7 touching the ink discharge surface 6 is composed of an elastic material such as rubber. More specifically, the core of the cleaning roller 7 is composed of materials such as metal or hard resin, but the periphery of the core is composed of an elastic material. The cleaning roller 7 may be entirely composed of an elastic material such as rubber.

Floating springs 11 are disposed on the part where the cleaning roller 7 is fixed to the head cap 5, as shown in FIG. 3. The floating springs 11 are means for biasing the cleaning roller 7 towards the ink discharge surface 6 of the print head 4. The floating springs 11, for example, may be leaf springs, which are U-shaped when viewed from the side and are inserted in the lower portion of the pins 9 in the vicinity of the retainers 10. The biasing force of the floating springs 11 works on the pins 9 on both edges and presses the cleaning roller 7 against the ink discharge surface 6 of the print head 4 with a substantially uniform force.

As a result, as shown in FIG. 2, with the head cap 5 attached to the bottom surface of the ink cartridge 3, the biasing force of the floating springs 11, the elasticity of the cleaning roller 7, and the crowned shape cause the full length of the cleaning roller 7 to touch the ink discharge surface 6 of the print head 4. The floating springs 11 is not limited to a leaf spring and may be a coil spring.

The cleaning roller 7 is rolled by touching the ink discharge surface 6 of the print head 4. Consequently, as shown in FIG. 2, the head cap 5 moves in the direction of arrow A, causing the cleaning roller 7 to rotate while pressing down on the entire ink discharge surface 6 of the print head 4 with moderate pressure. As the cleaning roller 7 rolls, the ink on the ink discharge surface 6 is cleaned off.

Figure 6:
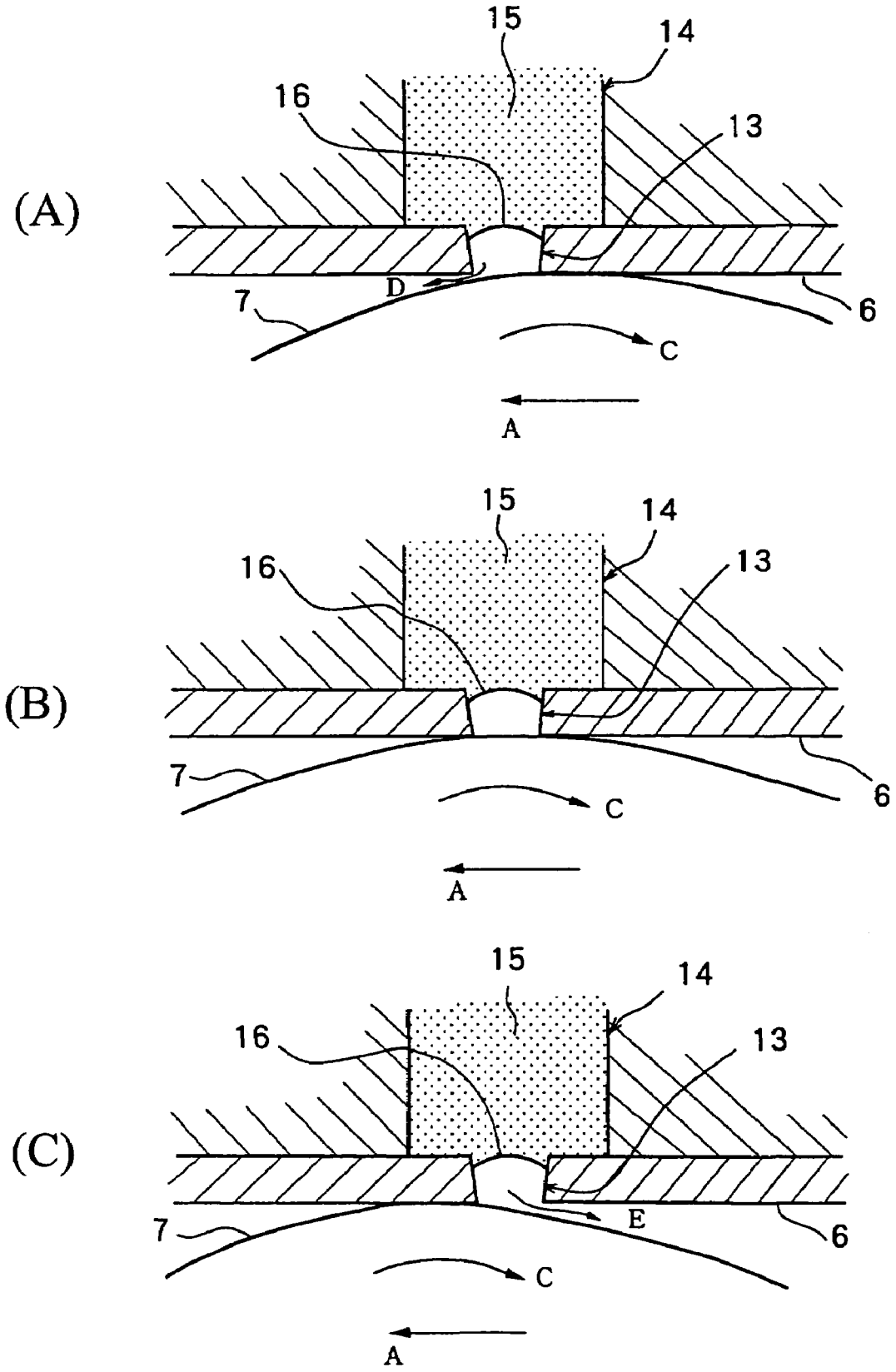
FIG. 6 is an enlarged cross-sectional view for describing the cleaning action, by the cleaning roller, of the ink discharge surface of the print head and the head method for cleaning.

In the following, the cleaning action by the cleaning roller 7 of the ink discharge surface 6 of the print head 4 and method for cleaning a head are described by referring to FIG. 6. In FIG. 6, to make the description easily understandable, the ink discharge surface 6, the ink discharge holes 13, and the cleaning roller 7 are shown in an enlarged cross-sectional view. As shown in FIG. 6, the cleaning roller 7 moves in the directions of arrows A and B together with the head cap 5 shown in FIG. 2. At the same time, the cleaning roller 7 is rolled in the direction of arrow C while touching the ink discharge surface 6. Then the cleaning roller 7 passes by a row of ink discharge holes 13 on the ink discharge surface 6 of the print head 4 shown in FIG. 2.

FIG. 6(A) shows a state where the cleaning roller 7 is about to reach one of the holes in the rows of ink discharge hole 13 after moving in the direction of arrow A while rotating in the direction of arrow C. At this time, the ink discharge holes 13 are filled with ink 15 from the ink chamber 14. On the inside of the ink discharge holes 13, a meniscus 16, which is a concave surface caused by surface tension of the surface of the ink 15, is formed. As shown in FIG. 6(A), the cleaning roller 7 moves in the direction of arrow A as it is rotated in the direction of arrow C. As a result, the cleaning roller 7 seals the ink discharge holes 13 from the edge of the hole at one side. As the ink discharge holes 13 are being sealed, air is pushed out in the direction of arrow D from the gap created of the edge at the hole at the other side.

Then, as shown in FIG. 6(B), the cleaning roller 7 moves further in the direction of arrow A while rotating in the direction of arrow C. When the cleaning roller 7 comes right under the ink discharge holes 13, the hole becomes completely sealed. Since the cleaning roller 7 is pressed against the ink discharge surface 6, in a microscopic view, a portion of the surface of the cleaning roller 7 enters the ink discharge holes 13 due to its elasticity. As a result, the cleaning roller 7 seals the inlets of the ink discharge holes 13 as it pushes out the air inside the ink discharge holes 13.

Then, as shown in FIG. 6(C), the cleaning roller 7 moves further in the direction of arrow A while rotating in the direction of arrow C. As the cleaning roller 7 continues to seal the edge of the ink discharge holes 13 at one side, the edge at the other side of the holes is opened. In a microscopic view, when the portion of the surface of the cleaning roller 7 that has entered the ink discharge holes 13 comes apart from the edge of the holes at one side, the air sealed inside the ink discharge holes 13 is sucked out from the gap between the cleaning roller 7 and the edge of the holes at one side in the direction of arrow E.

In other words, the pressure inside the ink discharge holes 13 changes from positive pressure, which is caused by the air sealed inside the ink discharge holes 13 being pushed out from the holes, as shown in FIG. 6(B), to negative pressure, which is caused by the air inside the ink discharge holes 13 being pulled out of the holes, as shown in FIG. 6(C). As a result, the ink inside the ink discharge holes 13 is sucked out. Consequently, the residual ink inside the ink discharge holes 13 is pulled out by suction force to the outer side of the print head 4 shown in FIG. 2 and the residual ink in the ink discharge holes 13 is completely removed.

In this case, the cleaning roller 7, which is composed of a cylindrical elastic material such as rubber, is moved on the ink discharge surface 6. Therefore, the ink discharge surface 6 may be cleaned without damaging the resin protective layer covering the head electrode of the ink discharge surface 6.

Figure 7:
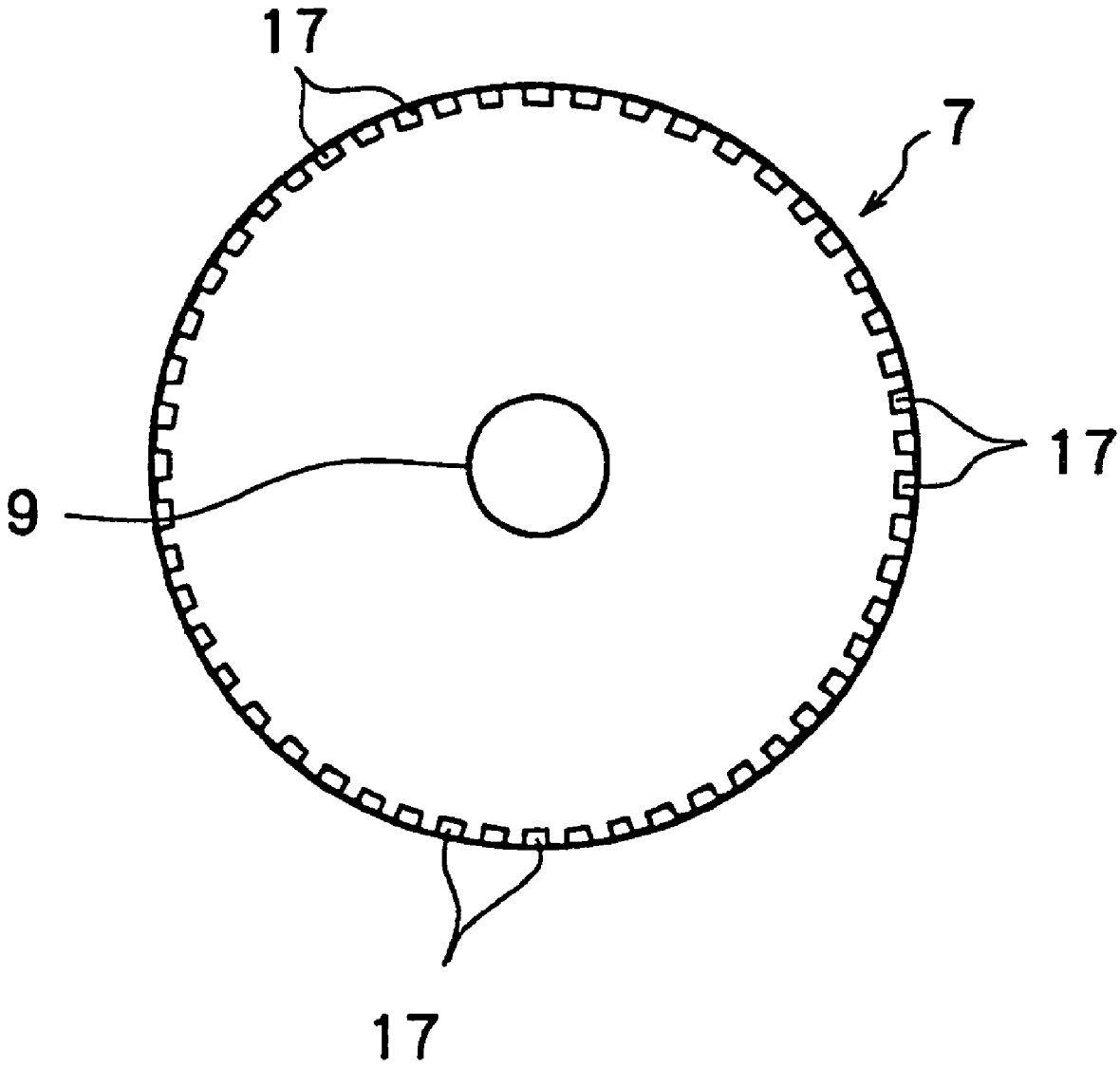
FIG. 7 is an enlarged cross-sectional view showing another embodiment of the cleaning roller.

FIG. 7 is a perspective view showing another embodiment of a cleaning roller 7. In this embodiment, the cleaning roller 7 is formed with a plurality of minute pores 17, 17, . . . on the peripheral surface. The inside diameter of the minute pores 17 is a size suitable for holding the ink taken up by capillary action.

In this case, as described in FIG. 6, the ink sucked and removed by the cleaning roller 7 and the ink wiped off by the peripheral surface of the cleaning roller 7 are caught in the plurality of minute pores 17, 17, . . . on the peripheral surface of the cleaning roller 7 by capillary action. Therefore, the ink may be completely cleaned off of the ink discharge surface 6.

The cleaning roller 7 may be composed of a cylindrical, spongy, elastic material with a plurality of minute pores 17, 17, . . . on the peripheral surface. In this case, ink sucked up into the plurality of minute pores 17, 17, . . . by capillary action is absorbed by the spongy center of the cleaning roller 7. Thus, the cleaning roller 7 may be used for cleaning even after cleaning has once been performed and with ink held inside the cleaning roller 7.

In another embodiment, a portion of a cleaning roller 7 touching an ink discharge surface 6 may be formed of a cellular material (i.e. foam or porous material, hereinafter referred to as 'foam'). Foam is categorized into three different types depending on the structure of the cells: closed cell type, open cell type, and semi-open cell type. The semi-open cell type is a type of foam with both open and closed cells. Any type of foam may be used. Closed cells are cells that exist independently, and open cells are cells that are partly or mostly connected to the neighboring cells.

Figure 8:
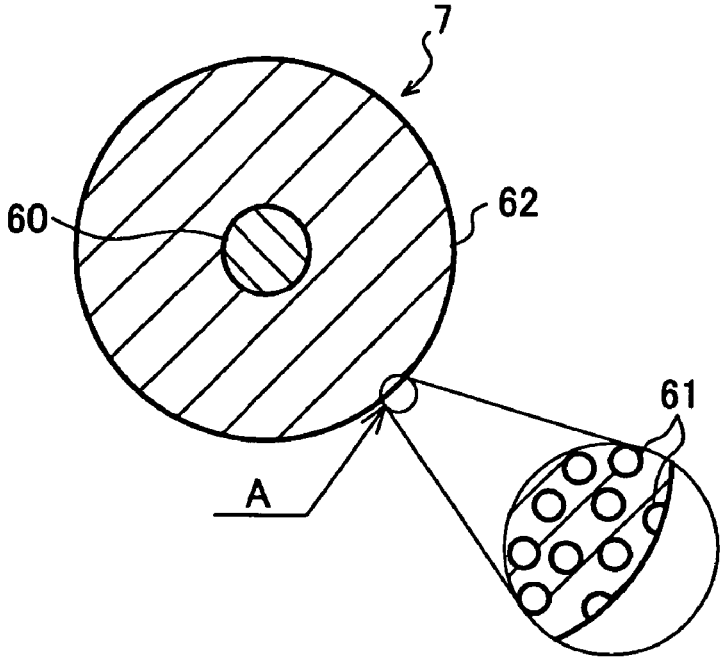
FIG. 8 is a cross-sectional view of a cleaning roller composed of a material with closed cells.
Figure 9:
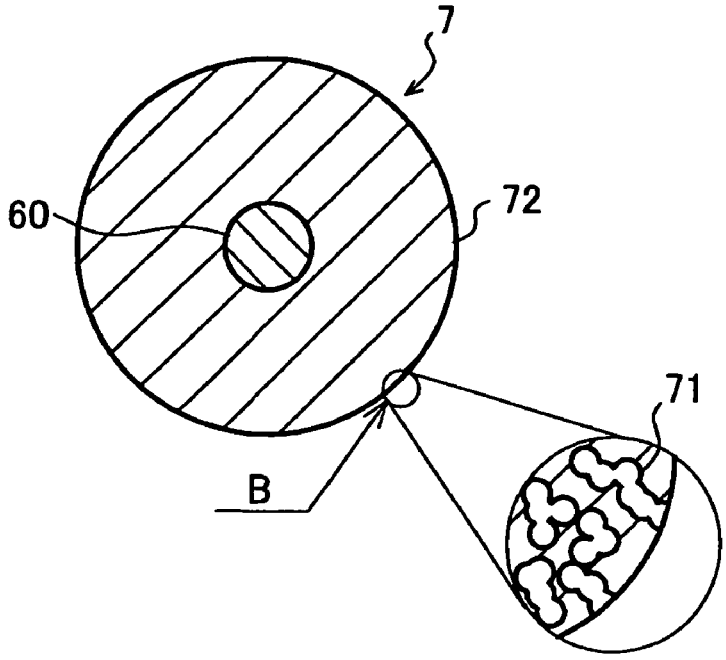
FIG. 9 is a cross-sectional view of a cleaning roller composed of a material with open cells.
Figure 10:
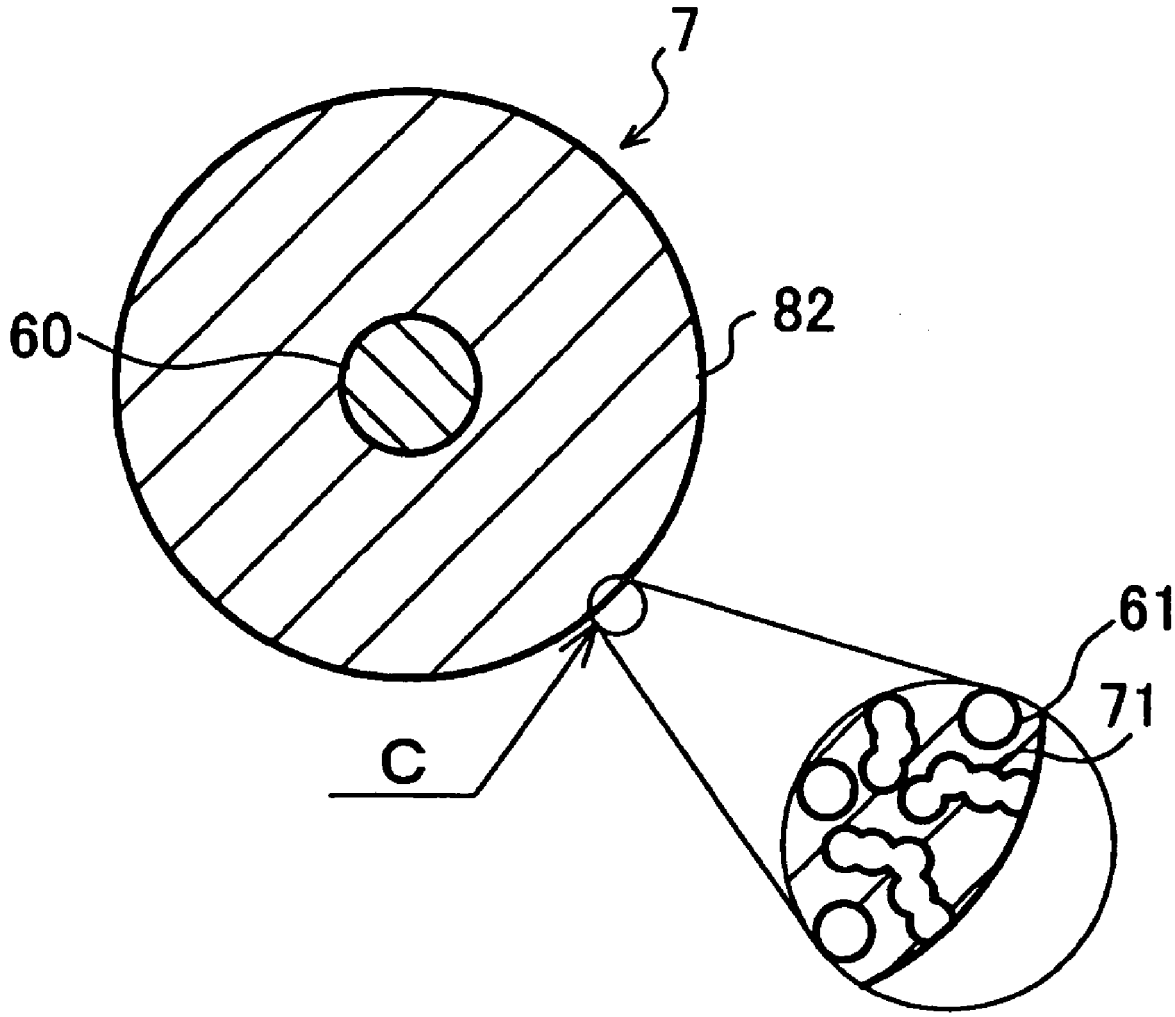
FIG. 10 is a cross-sectional view of a cleaning roller composed of a material with semi-open cells.

FIG. 8 shows a cross-sectional view of a cleaning roller 7 composed of foam with closed cells 61. FIG. 9 shows a cross-sectional view of a cleaning roller 7 composed of foam with open cells 71. FIG. 10 shows a cross-sectional view of a cleaning roller 7 composed with foam with both closed cells 61 and open cells 71 (i.e. semi-open cells). More specifically, as shown in FIGS. 8 to 10, the cleaning roller 7 according to these embodiment is composed of, for example, metal or hard resin and is made up of a core 60, having pins 9 formed at both ends, and a roller 62, 72, or 82, which is composed of one of the above foam types and is attached on the outer portion of the core 60.

For foam having closed cells or semi-open cells, ethylene-propylene terpolymer (EPDM foam), nitrile rubber (NBR), and sponge rubber such as silicon rubber may be used. For foam having open cells, urethane foam made from foamed polyurethane (PUR) may be used.

The cleaning roller 7 is structured, as shown in FIGS. 8 to 10. The portion of the cleaning roller 7 that touches the ink discharge surface 6 is elastic and holes formed by the cells on the surface of the roller absorb and hold the ink attached on the peripheral surface of the cleaning roller 7. In particular, for open cells, the effect of absorption (penetration) of ink by capillary action into the inner parts of the roller becomes greater and more ink can be held inside the cleaning roller 7.

In this case, the cleaning roller 7, including its peripheral surface, is composed of foam and, thus, is elastic. The cleaning roller 7 may be moved over the ink discharge surface 6 to clean the ink discharge surface 6 without damaging the resin protective layer covering the head electrode of the ink discharge surface 6.

The ink absorbed and removed is caught inside the peripheral surface of the cleaning roller 7 and then is absorbed into (penetrates into) the holes formed by the cells. For this reason, contamination caused by the absorbed and removed ink reattaching to the ink discharge surface 6 when cleaning is performed may be prevented. Thus, cleaning may be performed with a cleaning roller 7 that has already been used for cleaning and holds ink inside.

Figure 11:
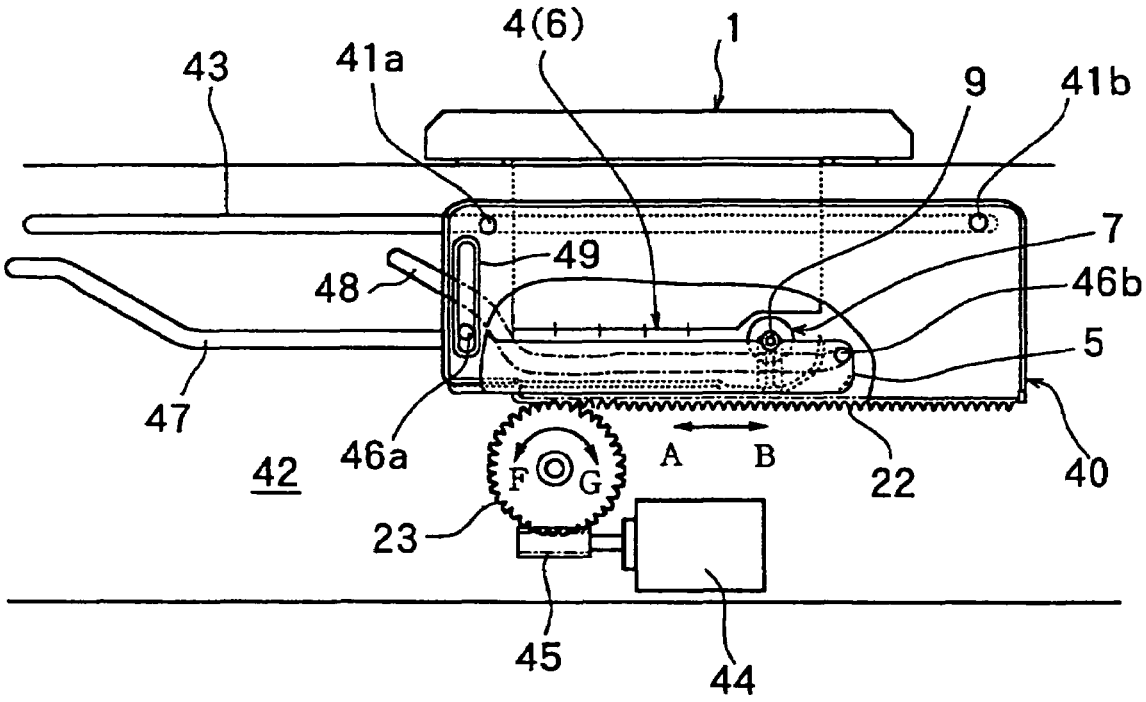
FIG. 11 is for describing the specific mechanism for rolling the cleaning roller shown in FIG. 2 and is a side view showing the details of a head cap closing mechanism shown in FIG. 1.
Figure 12:
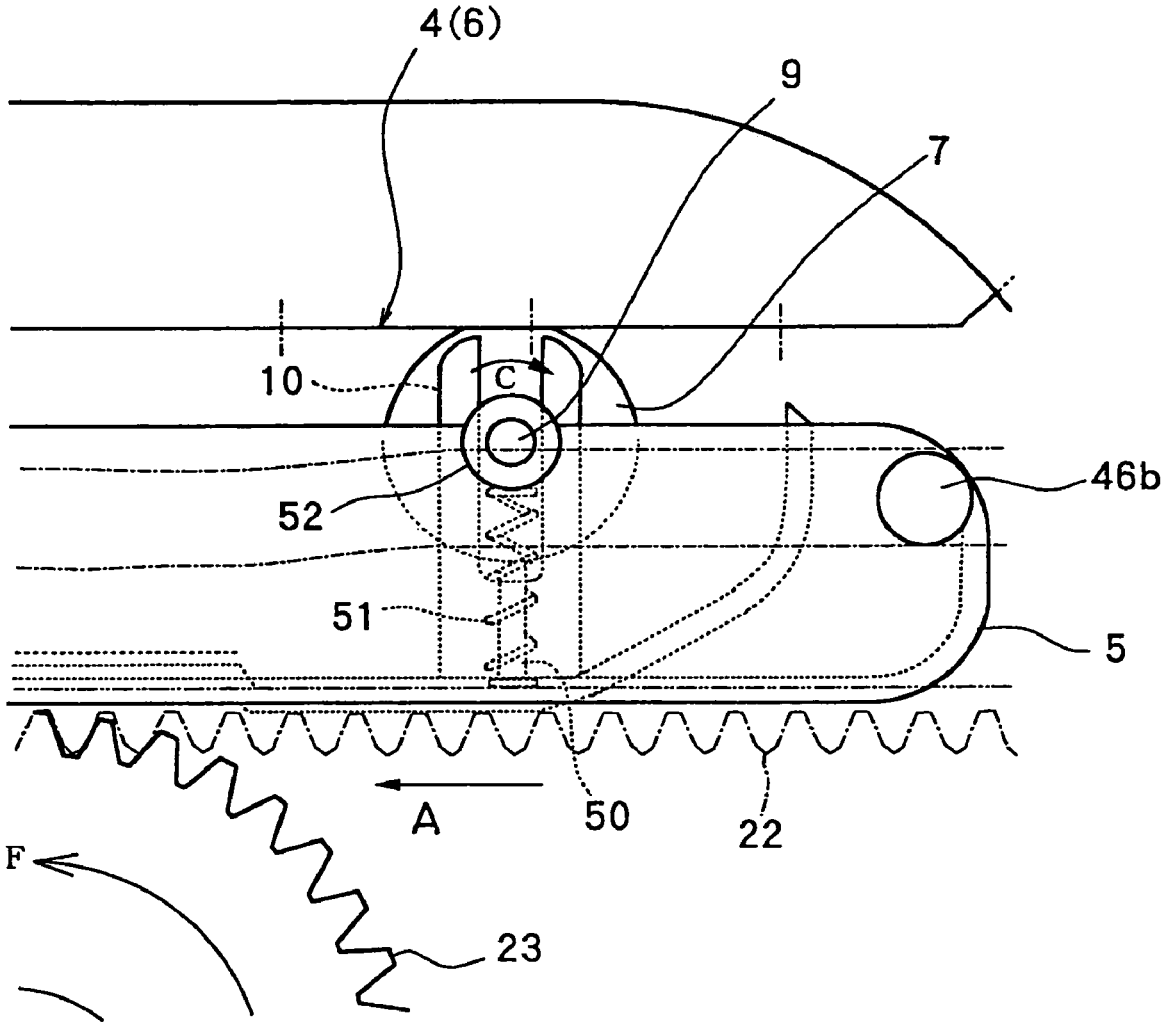
FIG. 12 is an enlarged side view of the main part of FIG. 11 and shows the detailed mechanism of the rolling of the cleaning roller.

Next, the mechanism for movement and rotation of the cleaning roller 7 shown in FIG. 2 is described in detail by referring to FIGS. 11 and 12. FIG. 11 is a side view showing details of a head cap opening mechanism 20 shown in FIG. 1. The cleaning roller 7 shown in FIG. 2 is attached to a head cap 5, and the head cap 5 is connected to and supported by a moving rack panel 40 having a linear-shaped rack 22 on the lower edge, as shown in FIG. 11.

The moving rack panel 40 moves the head cap 5 in the directions of arrows A and B. Two guide pins 41*a* and 41*b* are mounted on both upper ends on the inner sides of the moving rack panel 40. The guiding pins 41*a* and 41*b* are engaged with a linear guiding groove 43 formed on one of the outer panels 42 on the printer 2 shown in FIG. 1. The rack 22 formed on the lower edge is engaged with a pinion 23, which is rotated by a worm gear 45 on the rotational axis of a motor 44 attached to one of the outer panels 42. In this way, the moving rack panel 40 is supported.

On the front and back sides of one of the outer surfaces of the head cap 5, two cap guiding pins 46*a* and 46*b* extend towards the moving rack panel 40. On the intermediate portion of one of the outer panels 42 of the printer 2, two cap guide grooves 47 and 48, which are curved in a predetermined shape to form a moving path for the head cap 5, are formed. The front and back cap guiding pins 46*a* and 46*b* on the head cap 5 are each engaged with cap guiding grooves 47 and 48 on the outer panel 42 of the printer 2. Further, the cap guide pin 46*a* is engaged with a guiding groove 49 formed on the front edge of the moving rack panel 40 in the longitudinal direction.

This mechanism rotates the pinion 23 in the direction of the arrows F and G via the worm gear 45 driven by the motor 44. Then the rack 22 engaged with the pinion 23 moves the moving rack panel 40 in the directions of arrows A and B. The cap guiding pin 46*a* on the front of the head cap 5 is engaged with the guiding groove 49 on the front end of the moving rack panel 40, and, thus, the head cap 5 and the moving rack panel 40 both move in the directions of arrows A and B. At this time, the moving path of the head cap 5 is determined by the shapes of the cap guiding grooves 47 and 48, with which the front and back cap guiding pins 46*a* and 46*b* engage, respectively.

FIG. 12 is an enlarged side view of the main part of FIG. 11 and shows the detailed mechanism of the rolling of the cleaning roller 7. More specifically, inside the head cap 5, spring supporters 50 are vertically arranged on the inner sides of the retainers 10 supporting the pins 9 on each end of the cleaning roller 7. A coil spring 51 is wrapped around the spring supporter 50. The upper end of the coil spring 51 urges the lower surface of a bearing 52, which supports and allows rotation of each pin 9 of the cleaning roller 7.

Consequently, the elasticity of the coil spring 51 constantly urges the cleaning roller 7 in an upward direction and presses the print head 4 against the ink discharge surface 6. As a result, when the head cap 5 moves in the direction of arrow A, as shown in FIG. 11, the cleaning roller 7 pressed against the ink discharge surface 6 rolls in the direction of arrow C by being pressed against the ink discharge surface 6.

Figure 13:
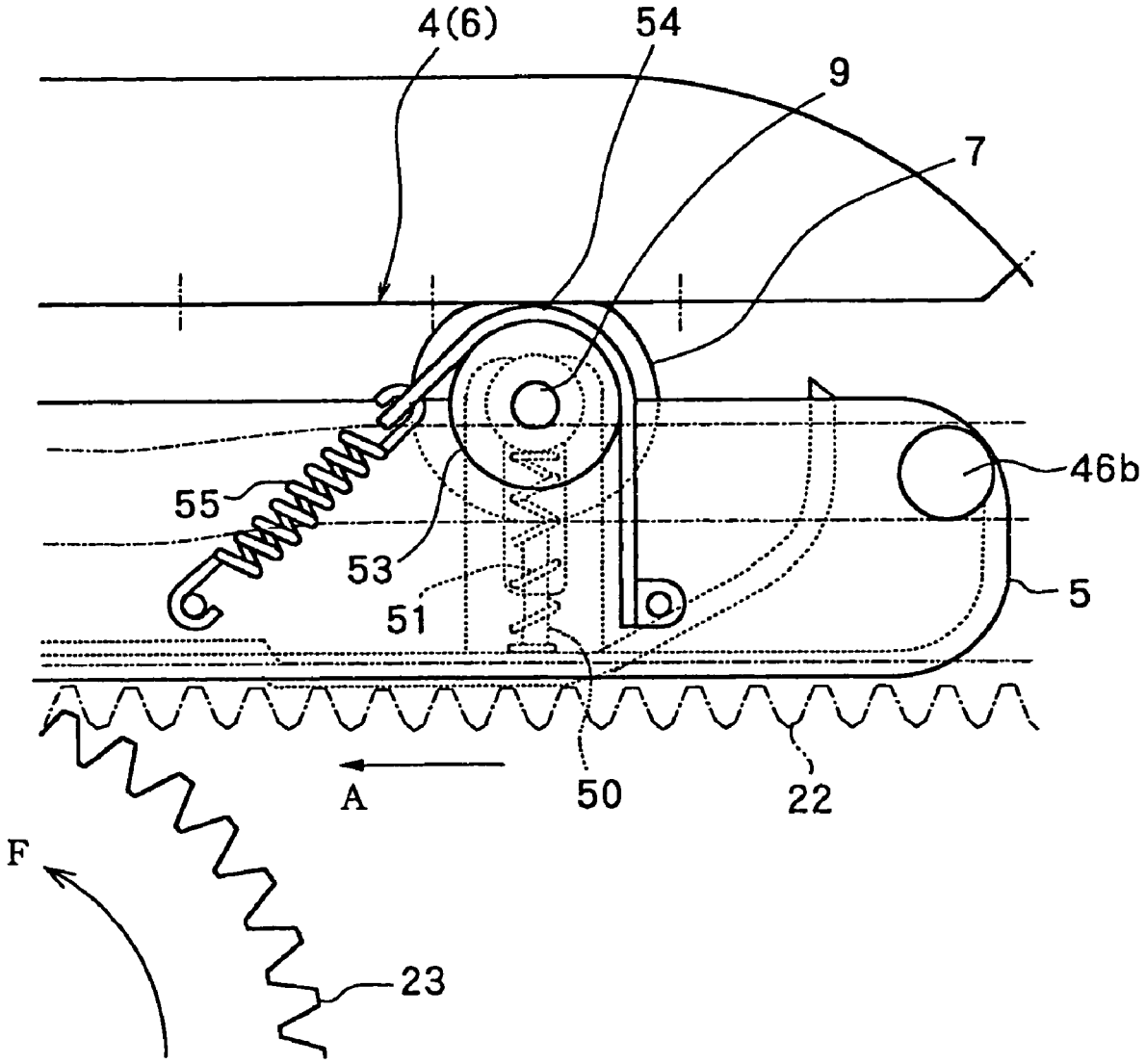
FIG. 13 is an enlarged side view of the main part showing another embodiment of the moving mechanism of the cleaning roller and shows the detailed structure of the braking mechanism of the cleaning roller.

FIG. 13 is an enlarged side view of the main part showing another embodiment of a moving mechanism of the cleaning roller 7. This embodiment has a braking mechanism for limiting the rotation of the cleaning roller 7. As the rotation of the cleaning roller 7 is limited by the braking mechanism, the cleaning roller 7 rolls while rubbing against the ink discharge surface 6. The braking mechanism, as shown in FIG. 13, consists of the following: for example, a hollow or solid cylindrical brake drum 53 integrally fixed to each of the pins 9 of the cleaning roller 7; a strip-like brake shoe 54 wrapped around the peripheral surface of the brake drum 53, one end thereof being fixed; and a pulling spring 55 connected to the other end of the brake shoe 54 to apply moderate tightening force.

Consequently, when the cleaning roller 7 rolls because of being pressed against the ink discharge surface 6, the tightening force of the braking shoe 54 applies a brake to the rotation of the brake drum 53 and the cleaning roller 7 rolls while rubbing against the ink discharge surface 6 while its rotation is limited by the braking mechanism. In this case, the cleaning roller 7 rotates only a small amount as it rubs against the ink discharge surface 6. For this reason, in addition to the liquid ink, the solidified ink stuck onto the ink discharge surface 6 may be cleaned off without damaging the ink discharge surface 6. The braking mechanism is not limited to the structure shown in FIG. 13 and may adopt any other structure as long as the rotation of the cleaning roller 7 is limited.

Figure 14:
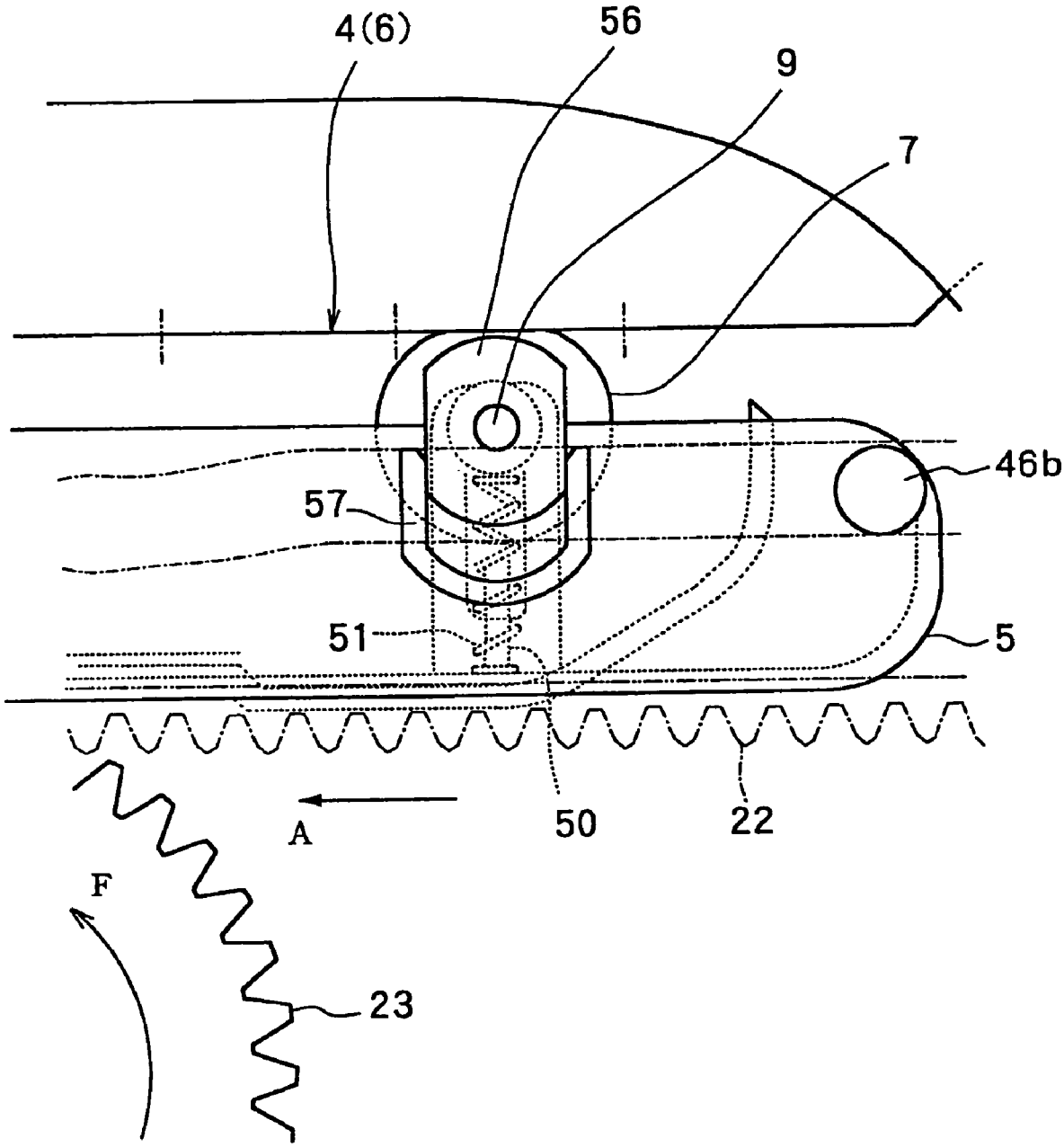
FIG. 14 is an enlarged side view of the main part showing another embodiment of the moving mechanism of the cleaning roller and shows the detailed structure of the fixing mechanism of the cleaning roller.

FIG. 14 is an enlarged side view of the main part showing another embodiment of a moving mechanism of a cleaning roller 7. This embodiment has a fixing mechanism for inhibiting the rotation of the cleaning roller 7. The cleaning roller 7 moves on an ink discharge surface 6 while being fixed and while its rotation is inhibited by the fixing mechanism. The fixing mechanism, as shown in FIG. 14, consists of, for example, a rectangular rotation-limiting piece 56 integrally fixed to each of pins 9 of the cleaning roller 7 and a concave holder 57, which holds and locks the facing sides of the rotation-limiting piece 56.

In this way, even if the cleaning roller 7 tries to roll because of being pressed against the ink discharge surface 6, the facing sides of the rotation-limiting piece 56 are locked by the holder 57, and, thus, the cleaning roller 7 will move on the ink discharge surface 6 without rotating and while being fixed by the fixing mechanism. In this case, the cleaning roller 7 moves while being rubbed against the ink discharge surface 6. For this reason, in addition to the liquid ink, the solidified ink stuck onto the ink discharge surface 6 may be cleaned off without damaging the ink discharge surface 6. The fixing mechanism is not limited to the structure shown in FIG. 14 and may adopt any other structure that can lock the rotation of the cleaning roller 7.

Figure 15:
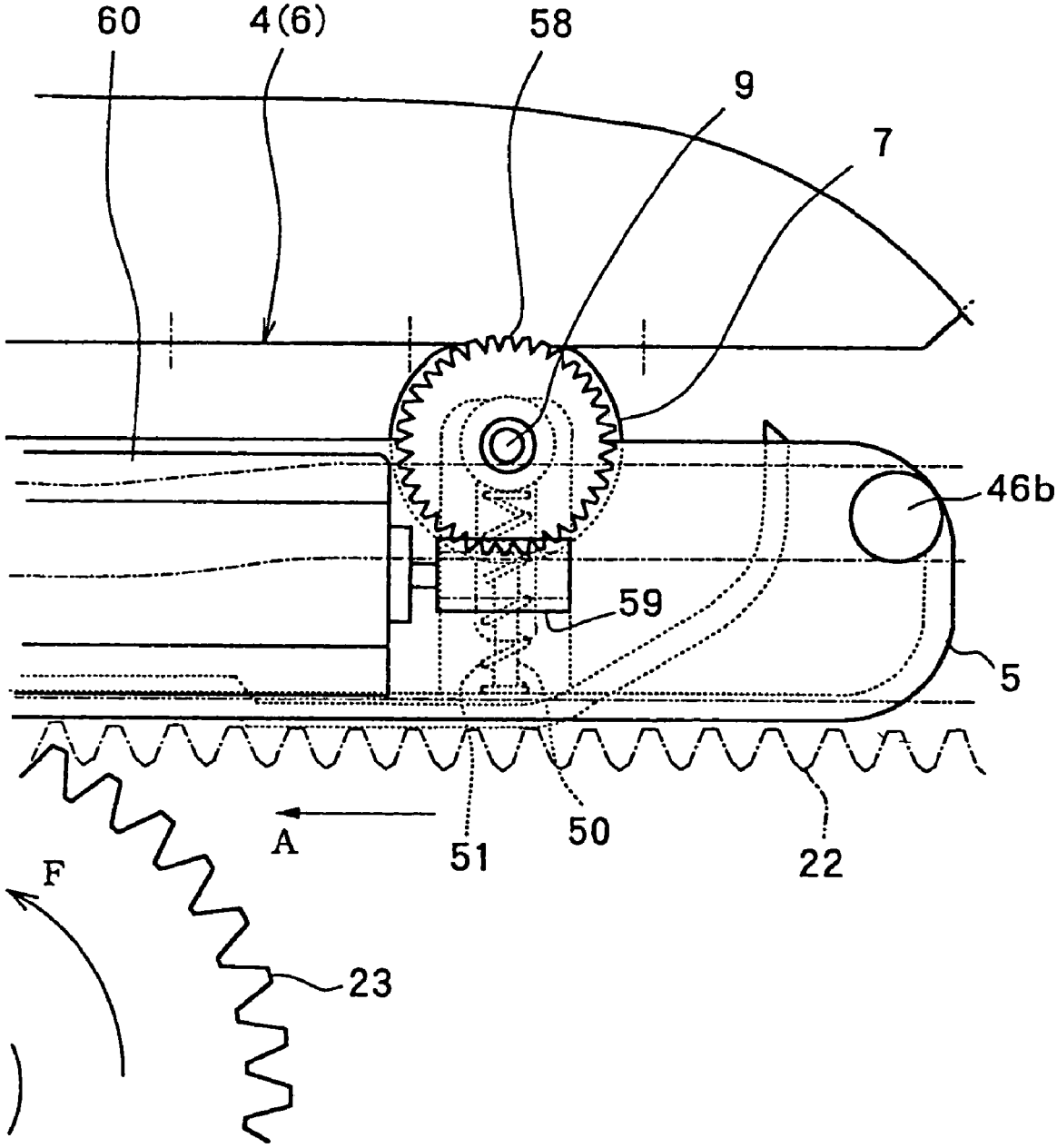
FIG. 15 is an enlarged side view of the main part showing another embodiment of the moving mechanism of the cleaning roller and shows the detailed structure of the rotation driving mechanism of the cleaning roller.

FIG. 15 is an enlarged side view of the main part showing another embodiment of a moving mechanism of a cleaning roller 7. This embodiment has a rotation driving mechanism for rotating the cleaning roller 7. The cleaning roller 7 rolls on an ink discharge surface 6 by the rotation driving mechanism. The rotation driving mechanism, as shown in FIG. 15, consists of a pinion gear 58 integrally fixed to one of pins 9 of the cleaning roller 7 and a driving motor 60 having a worm gear 59 engaged with the pinion gear 58 on the rotational axis. The rotation driving mechanism actively rotates the cleaning roller 7 in the forward or backward direction.

Figure 16A:
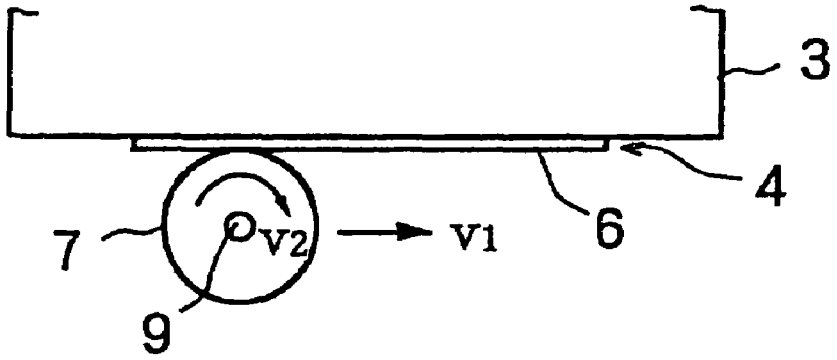
FIGS. 16A and 16B are explanatory drawings showing the movement of the cleaning roller along the ink discharge surface when driven by the rotation driving mechanism.

The cleaning roller 7 driven by the driving motor 60, as shown in FIG. 16A, rotates in the same direction as that of arrow A, which is the direction in which the head cap 5 moves, as shown in FIG. 2 (in FIG. 16A, the direction is to the right). Here, the rotation speed of the cleaning roller 7 is set so that the rotational speed v2 of the periphery of the cleaning roller 7 is greater than the traveling speed v1 of the head cap 5. In this case, the difference in speed of the ink discharge surface 6 of the print head 4 and the peripheral surface of the cleaning roller 7 causes the cleaning roller 7 to be rubbed against the ink discharge surface 6. As a result, the ink discharge surface 6 is completely cleaned. Even if the driving motor 60 is rotated so that the traveling speed v1 of the head cap 5 becomes greater than the rotational speed v2 of the cleaning roller 7, the ink discharge surface 6 and the cleaning roller 7 are rubbed against each other, as described above, and the ink discharge surface 6 is completely cleaned.

Figure 16B:
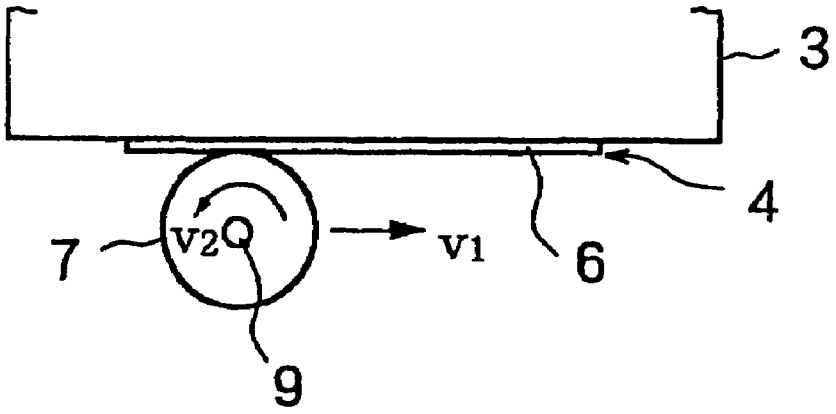

On the contrary, as shown in FIG. 16B, the cleaning roller 7 may be rotated in the direction opposite to the direction of arrow A of the head cap 5 shown in FIG. 3 (in FIG. 16B, the direction is to the left). In this case, the difference in the direction of movement of the ink discharge surface 6 of the print head 4 and the peripheral surface of the cleaning roller 7 causes the cleaning roller 7 to be rubbed against the ink discharge surface 6. As a result, the ink discharge surface 6 is completely cleaned.

As shown in FIG. 15, in this embodiment, the ink discharge surface 6 of the print head 4 is cleaned with a new peripheral surface of the cleaning roller 7, which appears as the cleaning roller 7 actively rotates.

Figure 17A:
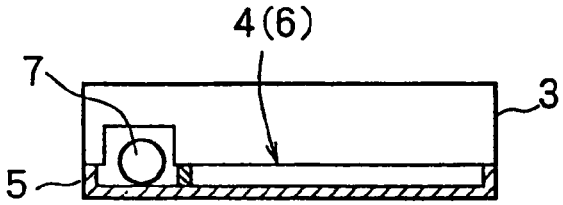
FIGS. 17A to 17F are explanatory drawings showing the cleaning movement of the head cap and cleaning roller.

The series of cleaning operations of the cleaning roller 7 of the inkjet head 1 structured as described above is described by referring to FIGS. 17A to 17F. The head cap 5 on the inkjet head 1 shown in FIG. 2 moves in the direction of arrow A, and the ink discharge surface 6 of the print head 4 is cleaned. Then, finally, preliminary ink is discharged. FIG. 17A shows the initial state wherein the head cap 5 on the ink cartridge 3 is closed. FIG. 1 shows the inkjet head 1 stowed in the printer 2 in this initial state.

Figure 17B:
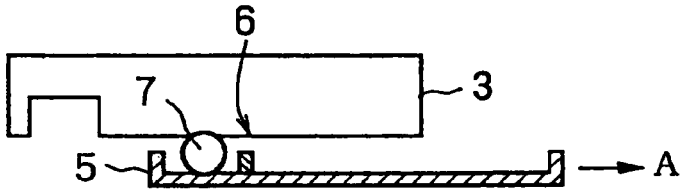

The head cap 5 installed on the printer 2 receives a head cap opening signal and moves in the direction of arrow A relative to the ink cartridge 3, as shown in FIG. 17B. Together with the head cap 5, the cleaning roller 7 moves in the direction of arrow A relative to the ink cartridge 3 to clean the ink discharge surface 6 while being pressed against the ink discharge surface 6 of the print head 4. The cleaning roller 7 rolls while touching the ink discharge surface 6 wherein the rotation of the cleaning roller 7 might be limited by the braking mechanism or the fixing mechanism or the rotation might be driven in the forward or backward direction by the rotation driving mechanism.

If the portion of the ink discharge surface 6 for yellow (Y) ink of the entire ink discharge surface 6 of the print head 4, as shown in FIG. 2, is cleaned, means for position detection (not shown in the drawing) installed on the lower surface of the head cap 5 detects the completion of the cleaning of the portion of the ink discharge surface 6 for yellow (Y) ink. Consequently, a starting signal for preliminary ink discharge is sent to the ink discharge holes on the ink discharge surface 6 for yellow (Y) ink.

Figure 17C:
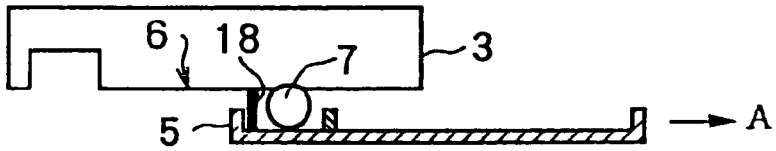

As shown in FIG. 17C, from the ink discharge holes on the ink discharge surface 6 for yellow (Y) ink, preliminary discharge ink 18 is discharged. Then, a termination signal for preliminary ink discharge is sent to the ink discharge holes on the ink discharge surface 6 for yellow (Y) ink, and the preliminary ink discharge is terminated. Subsequently, in a similar manner, the portions of the ink discharge surface 6 for magenta (M), cyan (C), and black (K) shown in FIG. 2 are cleaned by the cleaning roller 7. When cleaning is completed, means for position detection detects the completion of cleaning and a starting signal and a termination signal for preliminary discharge of ink are sent to the applicable ink discharge holes. As a result, the timing of preliminary ink discharge of each ink discharge hole is controlled and preliminary ink discharge is performed in order.

Figure 17D:
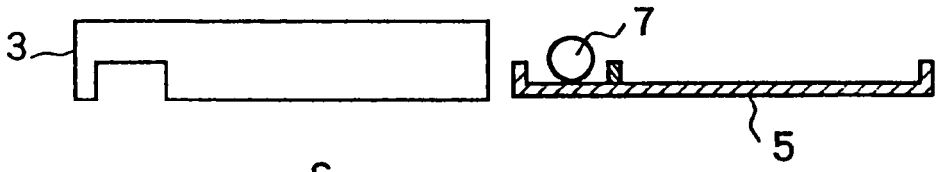

After the cleaning of each portion of the ink discharge surface 6 for each color and the preliminary ink discharge are completed, the head cap 5 fully moves in the direction of arrow A and then moves slightly upwards to be completely removed, as shown in FIG. 17D. With the head cap 5 removed, text and images are printed on the recording paper.

Figure 17E:
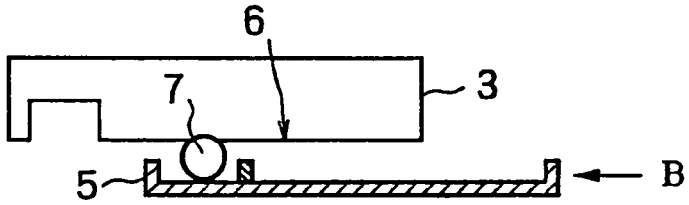

After text and images are printed on a desired number of pages, a head cap closing signal is sent, and the head cap 5 moves, as shown in FIG. 17E, relative to the ink cartridge 3 in the direction of arrow B from the removed position. Then, the cleaning roller 7 moves together with the head cap 5 relative to the ink cartridge 3 in the direction of arrow B. When the head cap 5 returns to its initial position, the cleaning roller 7 also returns to its initial position without touching the ink discharge surface 6 of the print head 4.

Figure 17F:
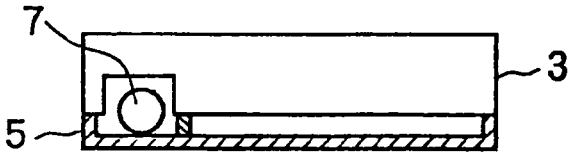

Subsequently, as shown in FIG. 17F, the head cap 5 fully moves in the direction of arrow B, relative to the ink cartridge 3, to cover the ink cartridge 3 and its initial state is restored. Once the initial state is restored, the head cap 5 waits for the next command for printing text and images.

In the operation described above, preliminary ink is discharged after cleaning of the ink discharge surface 6 of the print head 4 is performed. However, if the cleaning roller 7 does not cause mixing of different colors of ink by touching the ink discharge surface 6, preliminary ink may be discharged before cleaning of the ink discharge surface 6 by the cleaning roller 7 is performed. In this case, there is no need to control the timing of the preliminary ink discharge from each ink discharge hole for each color of ink (yellow (Y), magenta (M), cyan (C), and black (B)) using the means for position detection.

An image forming apparatus related to the inkjet head 1, for example an inkjet printer, is described by referring to FIGS. 1 and 18 to 24. The inkjet printer discharges fine droplets of ink from an inkjet head and prints images by spraying ink dots onto recording paper. As shown in FIG. 1, the inkjet printer consists of an inkjet head 1, a printer 2, a head removal mechanism 19, and a head cap opening mechanism 20. The inkjet printer is a type of inkjet printer wherein the inkjet head 1 is directly mounted on the printer 2.

The inkjet head 1 transforms liquid ink into fine droplets by, for example, electro-thermal conversion or electromechanical conversion and then spays ink dots onto recording paper. The inkjet head 1 is structured in the same manner as described in FIGS. 1 to 17.

The printer 2 functions as an inkjet printer by mounting the inkjet head 1 in a predetermined position and is equipped with a recording paper tray, a recording paper delivery system, an operation driving system, and a control circuit for the entire printer. In FIG. 1, reference number 21 refers to a receiving tray for the paper delivered after printing.

Figure 18:
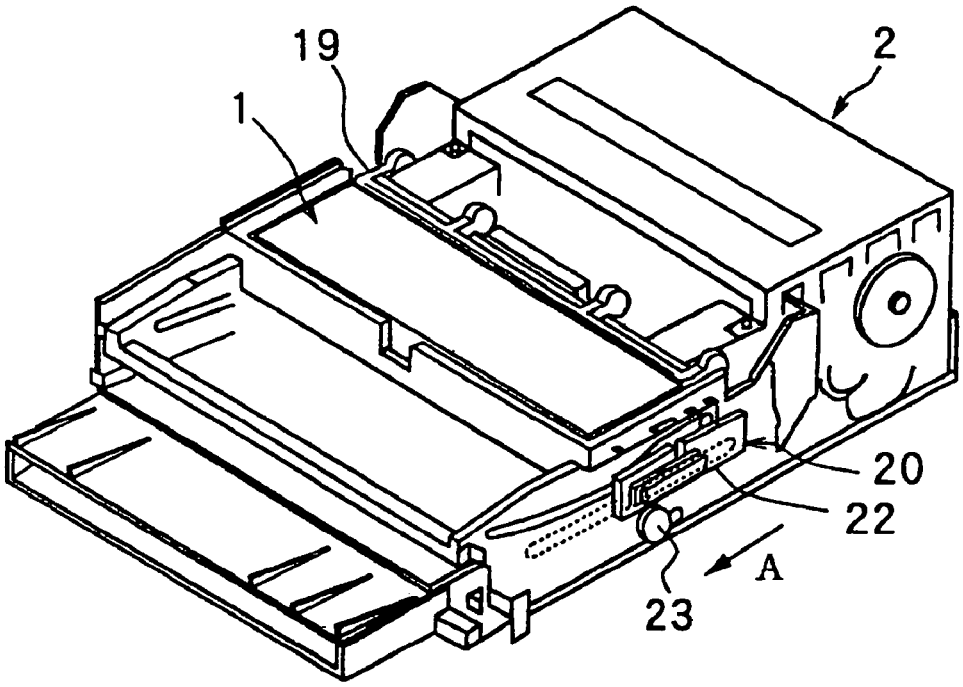
FIG. 18 is a perspective view showing an embodiment of the inkjet printer as an example of an image forming apparatus according to an embodiment and is a drawing showing the state with the inkjet head attached.

The head removal mechanism 19 mounts and fixes the inkjet head 1 in a predetermined position in the printer 2 and also releases the inkjet head 1. The head removal mechanism 19 consists of, for example, a horizontal stopper made so that it urges the upper surface of the inkjet head 1 inserted in a predetermined position, which is formed of a recessed portion in the center of the printer 2. In other words, the head removal mechanism 19 extends over the entire width of the printer 2 and may be turned, for example, in perpendicular and horizontal directions. As shown in FIG. 1, the inkjet head 1 is stowed in the direction of arrow H with the stopper standing perpendicularly. FIG. 18 shows the inkjet head 1 fixed in a predetermined position with the stopper pulled down in the horizontal direction.

The head cap opening mechanism 20 moves the head cap 5 relative to the print head 4 with the inkjet head 1 fixed in a predetermined position of the printer 2 to release the ink discharge surface 6 (refer to FIG. 2) and also closes the head cap 5 after printing is completed. The head cap opening mechanism 20 consists of, for example, engagement of a rack 22 and a pinion 23 mounted on the side surface of the printer 2. The detailed structure has already been described by referring to FIG. 11.

Figure 19:
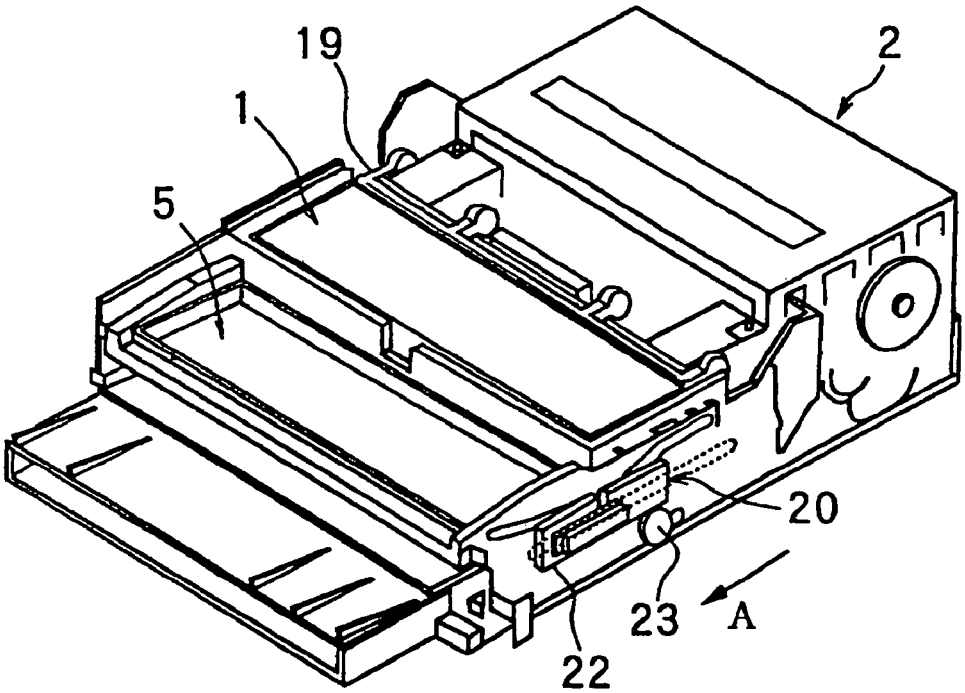
FIG. 19 is also a perspective view showing an embodiment of the inkjet printer and is a drawing showing the state with the head cap open.

As shown in FIG. 18, the inkjet head 1 is fixed in a predetermined position in the printer 2 by the head removal mechanism 19. By rotating the pinion 23 in a predetermined direction by the motor 44 shown in FIG. 11, the rack 22 moves in the direction of arrow A, as shown in FIG. 19. At the same time, the head cap 5 shown in FIG. 1 moves in the direction of arrow A and is opened to be completely removed.

The head cap opening mechanism 20 is not limited to engagement of the rack 22 and the pinion 23. Instead, for example, a rubber roller may be pressed against each side of the head cap 5 and a motor may be linked to the rotational axis of the rubber roller. Friction of the rubber roller generated by rotating the motor moves the head cap 5 in the direction of arrow A and opens the head cap 5.

Next, the detailed mechanism and operation for releasing the ink discharge surface 6 (refer to FIG. 2) by fixing the inkjet head 1 shown in FIG. 1 in a predetermined position of the printer 2 and moving the head cap 5 relative to the print head 4 (refer to FIG. 2) are described by referring to FIGS. 20 to 24.

Figure 20:
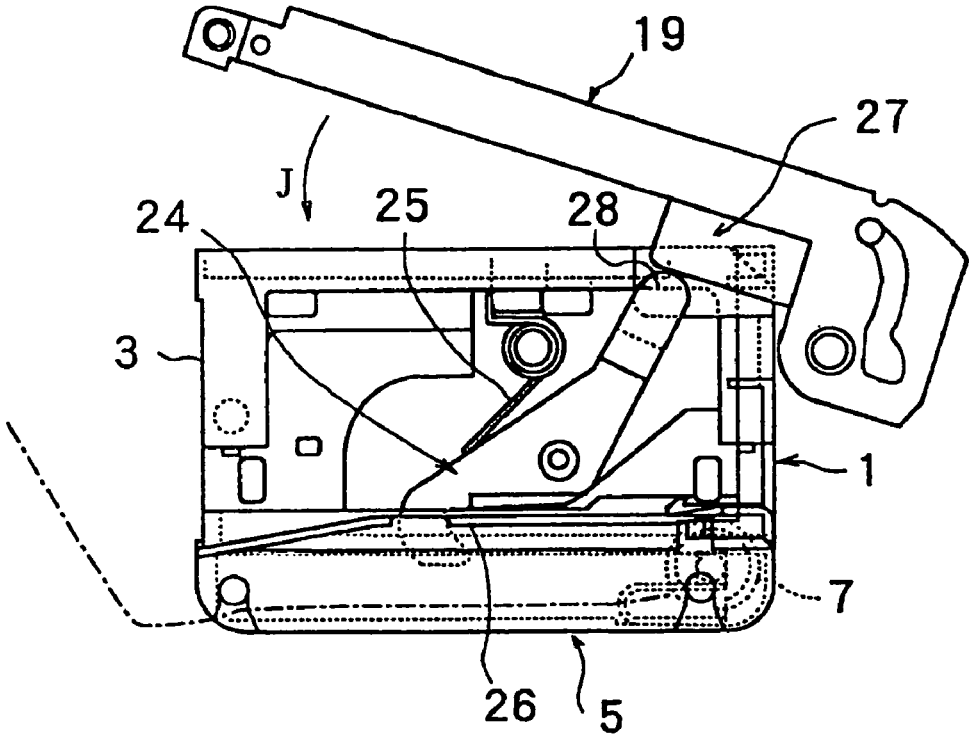
FIG. 20 is an explanatory drawing showing the detailed mechanism and action of the inkjet head being inserted in the direction of arrow H and stowed in a designated portion of the printer main body, as shown in FIG. 1.

FIG. 20 shows the inkjet head 1 being inserted in the direction of arrow H and stowed in a predetermined position of the printer 2. Here, the lower edge of each cap lock hook 24 installed on each inner edge of the inkjet head 1 is engaged to each stopper 26 on each side of the head cap 5 by the elasticity of a helical spring 25. In this way, the head cap 5 is integrally mounted to the ink cartridge 3.

Figure 21:
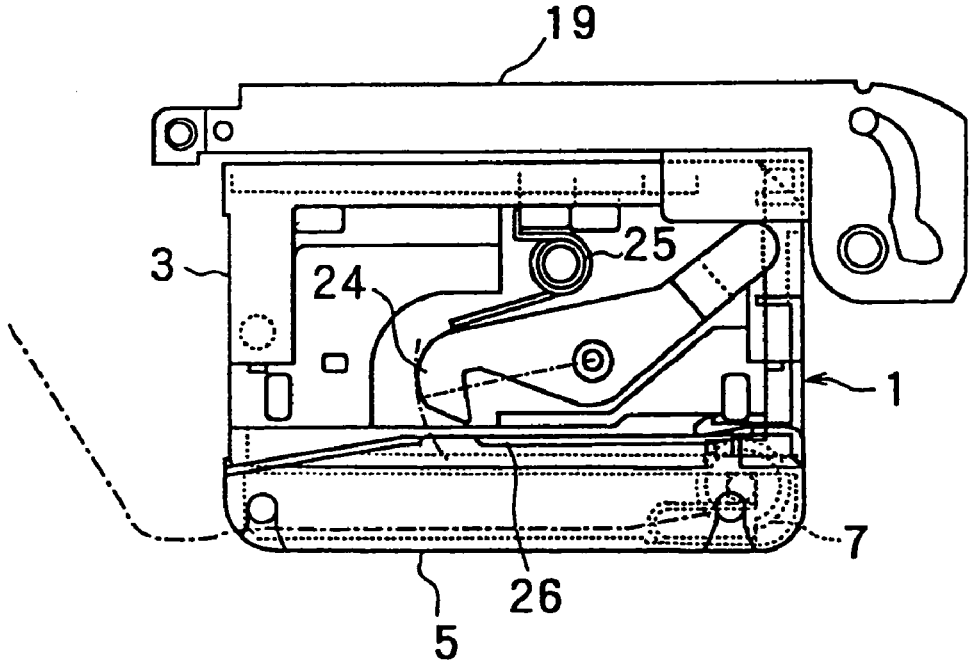
FIG. 21 is an explanatory drawing showing the detailed mechanism and action of the inkjet head being fixed to the designated portion of the printer main body with a head removal mechanism, the head cap being movable.

Here, the head removal mechanism 19 shown in FIG. 20 is fixed by being pressed down in the direction of arrow J. Then, a cap lock releasing piece 27 mounted on the lower edge of the head removal mechanism 19 urges and turns the upper edge of the cap lock hook 24 and, as shown in FIG. 21, pulls up the lower edge of the cap lock hook 24 to release the engagement with each stopper 26 on each side of the head cap 5. In this way, as shown in FIG. 18, the inkjet head 1 is fixed in a predetermined position in the printer 2 with the head removal mechanism 19 and, at the same time, the head cap 5 becomes movable.

Figure 22:
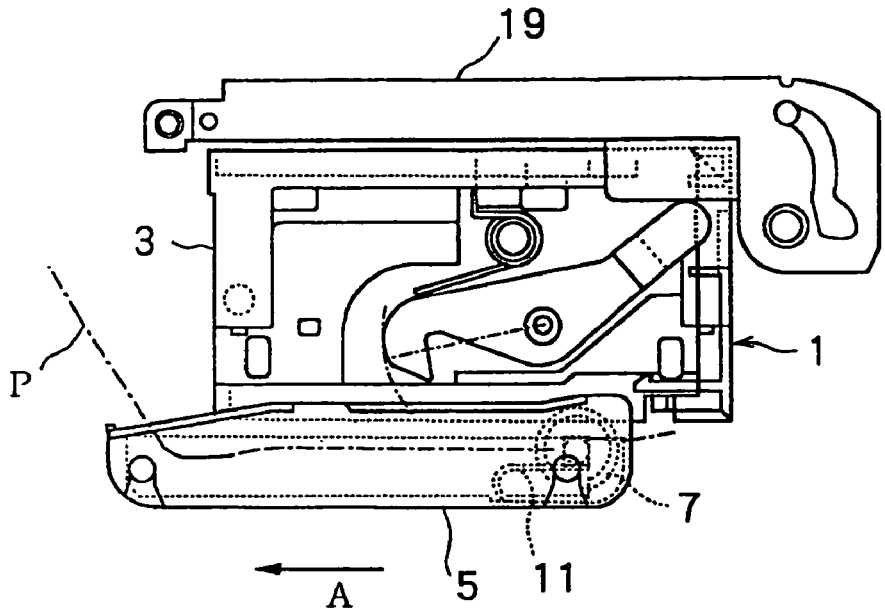
FIG. 22 is an explanatory drawing showing the detailed mechanism and action of the head cap fixed to the bottom side of the ink cartridge moving in the direction of arrow A and being opened.

Next, as shown in FIG. 21, the head cap opening mechanism 20 is activated and the pinion 23 is rotated by the motor 44 shown in FIG. 11 to move the rack 22 in the direction of arrow A. Then, as shown in FIG. 22, the head cap 5 mounted on the bottom surface of the ink cartridge 3 moves together with the rack 22 in the direction of arrow A and opens. As shown in FIG. 2, the ink discharge surface 6 of the print head 4 installed on the bottom surface of the ink cartridge 3 is cleaned with a cleaning roller 7 biased with the floating spring 11. In FIG. 22, reference character P indicates the moving path of the head cap 5.

Figure 23:
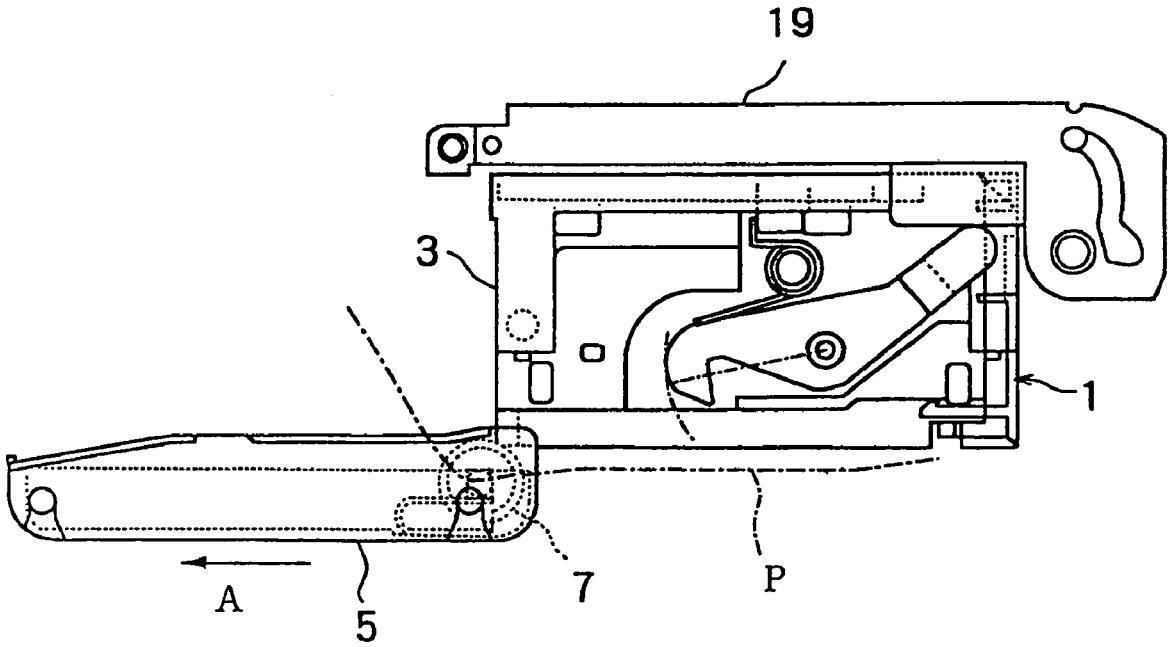
FIG. 23 is an explanatory drawing showing the detailed mechanism and action of the head cap moving in the direction of arrow A along the movement path P.

Then the head cap 5 is moved, as shown in FIG. 23, in the direction of arrow A along the moving path P. The cleaning roller 7 attached to the head cap 5 cleans the ink discharge surface 6 for each color of ink, yellow (Y), magenta (M), cyan (C), and black (K). Before and after cleaning, preliminary ink is discharged.

Figure 24:
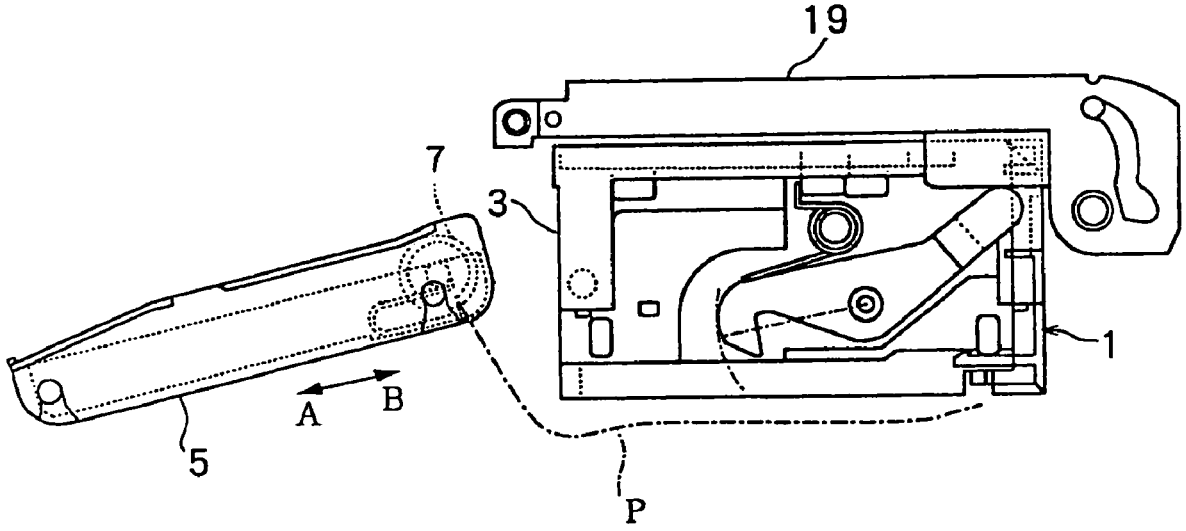
FIG. 24 is an explanatory drawing showing the detailed mechanism and action of the head cap being fully moved in the direction of arrow A along the movement path P and being completely removed.

After cleaning of the ink discharge surface 6 for each color and discharging of the preliminary ink are completed, the head cap 5 moves fully in the direction of arrow A along the moving path P, as shown in FIG. 24, and then moves slightly upwards, as shown in FIG. 22, to be completely removed. With the head cap 5 in this state, printing of text and images on recording paper is performed. Since the head cap 5 move slightly upwards, the stowing space for the head cap 5 may be small. As shown in FIG. 24, the recording paper passes below the print head 4 mounted on the bottom surface of the ink cartridge 3. The recording paper may be fed through the lower surface of the head cap 5. In this case, a rib may be installed on the lower-surface-side of the head cap 5 to feed the recording paper. Water repellent treatment may be applied to prevent the ink printed on the recording paper from being rubbed off.

After text and images are printed on a desired number of pages, the head cap 5 moves from the completely removed position, as shown in FIG. 24, in the direction of arrow B by reversing the steps described above. Then, as shown in FIG. 21, the head cap 5 returns to the bottom surface of the ink cartridge 3, and the initial condition is restored.

As shown in FIG. 20, the head removal mechanism 19 opens in the direction opposite to arrow J. This causes the cap lock hook 24 to be engaged with the stopper 26 on each side of the head cap 5 by the elasticity of the helical spring 25. Then the head cap 5 is integrally mounted on the ink cartridge 3. In this way, as shown in FIG. 1, the inkjet head 1 can be removed from the printer 2.

If the electrical power of the printer is shut off for some reason when the head cap 5 is completely removed, as shown in FIG. 24, the head cap 5 will remain in the completely removed position. If the head removal mechanism 19 opens, as shown in FIG. 20, in the direction opposite to arrow J, the ink cartridge 3 will be removed with the head cap 5 remaining in the completely removed position. To prevent this, when the power of the printer is shut off for some reason, the head cap 5 automatically returns to the initial position shown in FIG. 20. Alternatively, an interlock mechanism may be installed, which prevents the head removal mechanism 19 from opening in the direction opposite to arrow J when the head cap 5 is not in the initial position, as shown in FIG. 20.

The inkjet printer shown in FIGS. 1 and 18 to 24 is a type of inkjet printer wherein the inkjet head 1 is directly mounted on the printer 2. The present invention, however, is not limited to this type, and the inkjet printer may be an inkjet printer with an inkjet head 1 mounted on the printer 2 with a tray. In the following, an overview of another type of inkjet printer is described by referring to FIGS. 25A and 25B.

Figure 25A:
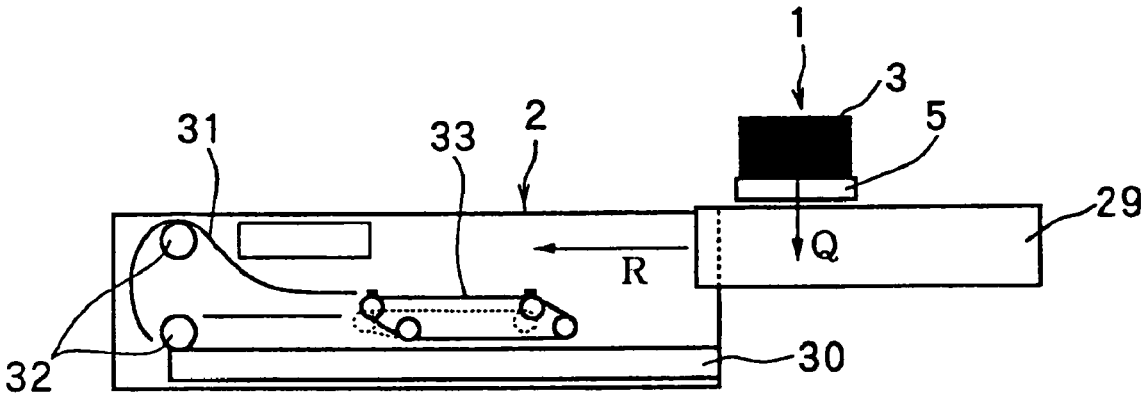
FIGS. 25A and 25B are overall explanatory drawings showing another type of inkjet printer wherein the inkjet head is fixed to the printer main body with a tray.
Figure 25B:
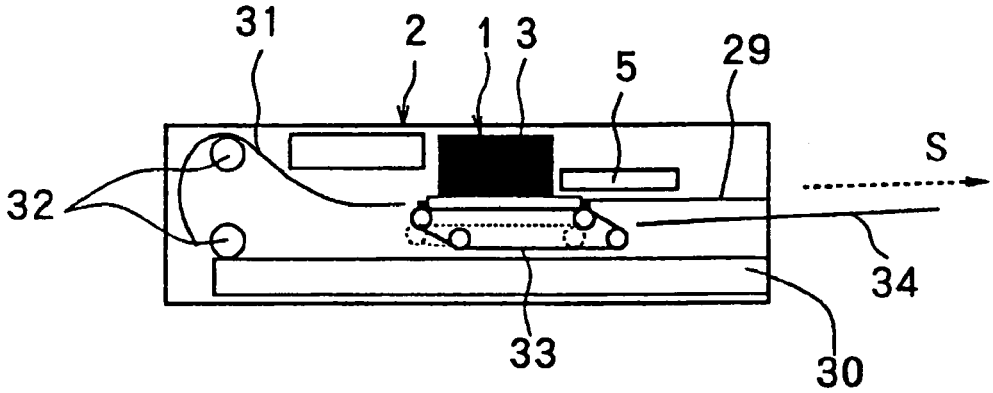

As shown in FIG. 25A, an inkjet head 1, wherein a head cap 5 is integrally mounted on an ink cartridge 3, is installed in the direction of arrow Q at a predetermined position of the inner side of a tray 29. The tray 29 can be inserted in a printer 2. The tray 29 is moved in the direction of arrow R to be set inside the printer 2. As shown in FIG. 25B, when the tray 29 moves in the direction of arrow R, the head cap 5 is stopped by stopping means inside the printer 2. The tray 29 is for setting or replacing the inkjet head 1 inside the printer 2.

Then, the tray 29 continues to move in the direction of arrow R to move the ink cartridge 3 in direction of R relative to the head cap 5. As a result, the head cap 5 opens. At the same time, when the head cap 5 moves in the direction of R relative to the ink cartridge 3, the operations shown in FIG. 17A to 17F cause the ink discharge surface 6 of the print head 4 to be cleaned and the preliminary ink to be discharged. Then, text and images are printed on recording paper.

In FIGS. 25A and 25B, reference numeral 30 indicates a recording paper tray, reference numeral 31 indicates recording paper, reference numeral 32 indicates a feeding roller, reference numeral 33 indicates a feeding belt, reference numeral 34 indicates a receiving tray, and reference character S indicates the direction in which the recording paper is delivered.

According to this embodiment, a cleaner formed of a cylindrical elastic material touches and moves relative to an ink discharge surface of a print head. By moving the cleaner so that its peripheral surface touches the ink discharge surface, the ink inside the ink discharge holes is absorbed and removed by a change in pressure inside the ink discharge holes. In this way, the ink discharge surface of the print head is undamaged and the effectiveness of cleaning the vicinity of the ink discharge surface of the print head is improved. Furthermore, since extra ink is not absorbed into the ink discharge holes, as in known cleaners using a suction pump, ink is not wasted.

The peripheral surface of the cleaner has a plurality of minute pores. The ink absorbed from the inside of the ink discharge holes by a change in pressure inside the ink discharge holes caused by moving the cleaner so that the cleaner's peripheral surface touches the ink discharge surface of the print head is caught inside the plurality of minute pores on the peripheral surface by capillary action. In this way, the ink is completely cleaned off the ink discharge surface without leaving any residual ink behind.

The cleaner is crowned; it has a slightly wider diameter in the middle. Therefore, even if the cleaner bends in the middle, it will not come apart from the ink discharge surface.

Since the cleaner moves on the ink discharge surface as it rolls while touching the ink discharge surface, the ink discharge surface of the print head is undamaged, and the effectiveness of cleaning the vicinity of the ink discharge surface is improved.

The cleaner has a braking mechanism for limiting the rotation of the cleaner. Since the cleaner rubs the ink discharge surface by rolling as its rotation is limited by the braking mechanism, the liquid ink and solidified ink on the ink discharge surface can be cleaned off without damaging the ink discharge surface.

The cleaner has a fixing mechanism for inhibiting the rotation of the cleaner. Since the cleaner moves on the ink discharge surface as its rotation is inhibited by the fixing mechanism, liquid ink and solidified ink on the ink discharge surface can be cleaned without damaging the ink discharge surface.

The cleaner has a rotation driving mechanism for driving the rotation of the cleaner. Since the cleaner rolls on the ink discharge surface by the rotation driving mechanism, the ink discharge surface of the print head can be cleaned with a new peripheral surface of the cleaner, which appears as the cleaner is actively rotated in a forward or backward direction.

The elastic cylindrical cleaner is formed of a cellular material with closed cells and/or open cells and moves relative to the ink discharge surface of the ink discharge surface as it touches the ink discharge surface. By moving the cleaner as its peripheral surface touches the ink discharge surface, the ink inside the ink discharge holes is absorbed and removed by a change in pressure inside the ink discharge holes. At the same time, the ink absorbed and removed is caught inside the cells and, thus, no residual ink is left on the ink discharge surface and the surface of the cleaner. In this way, the ink discharge surface of the print head is undamaged and the effectiveness of cleaning the vicinity of the ink discharge surface of the print head is improved. Furthermore, since extra ink is not absorbed into the ink discharge holes, as in known cleaners using a suction pump, ink is not wasted.

In the embodiment according to the present invention, an inkjet printer was described as a liquid discharge apparatus equipped with a liquid discharge head having a liquid discharge surface with rows of liquid discharge holes, which discharge liquid droplets. The present invention, however, is not limited to this and may be widely applied to other liquid discharge heads and liquid discharge apparatuses that discharge liquids. For example, the present invention may be applied to facsimile machines, copy machines, liquid discharge apparatuses for discharging DNA solutions for detecting biological specimens, and liquid discharge apparatuses for discharging liquids including electrically conductive particles forming wiring patterns on printed circuit boards.

As an embodiment according to the present invention, a line head inkjet printer was described. The present invention, however, is not limited to this and may be applied to serial inkjet printers.

INDUSTRIAL APPLICABILITY

A liquid discharge head, a method for cleaning the liquid discharge head and a liquid discharge apparatus may be applied to, for example, an inkjet head discharging ink droplets from ink discharge holes for forming images on a recording medium, a method for cleaning the inkjet head, and an inkjet printer.

The invention claimed is:

1. A liquid discharge head having a liquid discharge surface with rows of liquid discharge holes for discharging liquid droplets, comprising:

a cleaner formed of a cylindrical elastic material, wherein the cleaner includes a middle portion that tapers out to two end portions such that a diameter of the middle portion is larger than a diameter of die end portions;

a moving means for moving the cleaner relative to the liquid discharge surface while the cleaner is touching the liquid discharge surface; and wherein the cleaner includes a peripheral surface for absorbing liquid inside the liquid discharge holes by a change in pressure inside the liquid discharge holes caused when the cleaner moves while touching the liquid discharge surface.

2. The liquid discharge head according to claim 1, wherein the cleaner has minute holes on the peripheral surface thereof.

3. The liquid discharge head according to claim 1, wherein the peripheral surface of the cleaner is composed of a cellular material having open and/or closed cells.

4. The liquid discharge head according to claim 1, wherein the cleaner rolls on the liquid discharge surface while touching the liquid discharge surface.

5. The liquid discharge head according to claim 1, wherein the cleaner has a braking mechanism for limiting the rotation of the cleaner, so that the cleaner rolls and rubs the liquid discharge surface while the rotation is limited by the braking mechanism.

6. The liquid discharge head according to claim 1, wherein the cleaner has a fixing mechanism for inhibiting the rotation of the cleaner, so that the cleaner moves on the liquid discharge surface while the rotation is stopped by the fixing mechanism.

7. The liquid discharge head according to claim 1, wherein the cleaner has a rotation driving mechanism for driving the rotation of the cleaner, so that the cleaner rolls on the liquid discharge surface while the rotation is driven by the rotation driving mechanism.

8. The liquid discharge head according to claim 1, wherein the moving means moves the cleaner relative to the liquid discharge surface in a direction orthogonal to the longitudinal direction of the liquid discharge surface.

9. The liquid discharge head according to claim 1, further comprising a cap for protecting the liquid discharge surface wherein the cleaner moves together with the cap.

10. The liquid discharge head according to claim 1 being an inkjet head for forming images by discharging ink wherein the liquid discharge surface has rows of liquid discharge holes for one ink color or a plurality of ink colors.

11. A method for cleaning a liquid discharge head having a liquid discharge surface with rows of liquid discharge holes for discharging liquid droplets, the method comprising:

moving a cleaner formed of a cylindrical elastic material, wherein the cleaner includes a middle portion that tapers out to two end portions such that a diameter of the middle portion is larger than a diameter of the end portions, relative to the liquid discharge surface while the cleaner is touching the liquid discharge surface; and absorbing liquid inside the liquid discharge holes by a change in pressure inside the liquid discharge holes caused by the cleaner moving while touching the liquid discharge surface.

12. The method for cleaning for a liquid discharge head according to claim 11, wherein the cleaner has a peripheral surface with many minute holes and is moved on the liquid discharge surface while touching the liquid discharge surface.

13. The method for cleaning for a liquid discharge head according to claim 11, wherein the cleaner is composed of a cellular material having open and/or closed cells and is moved on the liquid discharge surface while the cleaner is touching the liquid discharge surface.

14. A liquid discharge apparatus for discharging liquid droplets from rows of liquid discharge holes formed on a liquid discharge surface, comprising;

a liquid discharge head equipped with a cleaner formed of a cylindrical elastic material wherein the cleaner includes a middle portion that tapers out to two end portions such that a diameter of the middle portion is larger than a diameter of the end portions;

a moving means for moving the cleaner relative to the liquid discharge surface while the cleaner is touching the liquid discharge surface wherein the cleaner has a peripheral surface for absorbing liquid inside the liquid discharge holes by a change in pressure inside the liquid discharge holes caused by the cleaner moving while touching the liquid discharge surface; and a head removal mechanism for fixing the liquid discharge head on a predetermined portion of the apparatus and for releasing the head from the main body of the apparatus.

15. The liquid discharge apparatus according to claim 14, wherein a peripheral surface of the cleaner is composed of a material having holes.

16. The liquid discharge apparatus according to claim 14, wherein a peripheral surface of the cleaner is composed of a cellular material having open and/or closed cells.

17. The liquid discharge apparatus according to claim 14, wherein the liquid discharge head is an inkjet head for forming images by discharging ink and the liquid discharge surface has rows of liquid discharge holes for one ink color or a plurality of ink colors.

* * * * *